US006853370B2

(12) United States Patent
Numao

(10) Patent No.: US 6,853,370 B2
(45) Date of Patent: Feb. 8, 2005

(54) DISPLAY DEVICE WITH ELECTRO-OPTICAL ELEMENT ACTIVATED FROM PLURAL MEMORY ELEMENTS

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 418 days.

(21) Appl. No.: 10/035,440

(22) Filed: Jan. 4, 2002

(65) Prior Publication Data

US 2002/0089496 A1 Jul. 11, 2002

(30) Foreign Application Priority Data

Jan. 10, 2001 (JP) ..... 2001-003051
May 22, 2001 (JP) ..... 2001-153097

(51) Int. Cl.[7] ..... G09G 5/00
(52) U.S. Cl. ..... 345/204; 345/45; 345/50; 315/169.3
(58) Field of Search ..... 345/204, 205, 345/89, 98, 100, 96, 206, 55, 84, 30, 33, 45, 48, 50, 51; 315/169.3, 169.4

(56) References Cited

U.S. PATENT DOCUMENTS

| | | | | |
|---|---|---|---|---|
| 4,996,523 A | | 2/1991 | Bell et al. | |
| 5,349,366 A | * | 9/1994 | Yamazaki et al. | 345/92 |
| 5,712,652 A | * | 1/1998 | Sato et al. | 345/90 |
| 5,945,972 A | * | 8/1999 | Okumura et al. | 345/98 |
| 6,339,417 B1 | * | 1/2002 | Quanrud | 345/98 |
| 6,636,194 B2 | * | 10/2003 | Ishii | 345/98 |
| 2003/0011314 A1 | * | 1/2003 | Numao | 315/169.3 |

FOREIGN PATENT DOCUMENTS

| | | |
|---|---|---|
| JP | 52-149999 | 12/1977 |
| JP | 3-64791 A | 3/1991 |
| JP | 5-249490 A | 9/1993 |
| JP | 6-208346 A | 11/1994 |
| JP | 08-194205 | 7/1996 |
| JP | 9-212140 A | 8/1997 |
| JP | 10-301536 | 11/1998 |
| JP | 11-109891 | 4/1999 |
| JP | 11-160676 A | 6/1999 |
| JP | 11-202290 | 7/1999 |
| JP | 2000-169297 | 6/2000 |
| JP | 2000-227608 | 8/2000 |
| JP | 2002-169503 A | 6/2002 |
| JP | 2002-196306 A | 7/2002 |

OTHER PUBLICATIONS

SID KPS Proceedings of the $18_{th}$ International Display Research Conference, Sep. 28–Oct. 1, 1998 Seoul, Korea, pp. 285–288.

Japanese Notice of Rejection and English translation thereof mailed Jun. 8, 2004 in corresponding JP application 2001–153097.

* cited by examiner

*Primary Examiner*—Richard Hjerpe
*Assistant Examiner*—Ronald Laneau
(74) *Attorney, Agent, or Firm*—Nixon & Vanderhye, P.C.

(57) ABSTRACT

In a display device, an active element (A) captures data of a signal line into a memory element while the active element (A) is selected by a selection line. The active element applies a reference voltage to an organic EL element according to storage contents of the memory element, thereby performing a storage holding operation for each pixel while preventing rewriting of the same data so as to save power. In order to realize multi-gray-level display, the display device reduces the number of wires and power consumption.

22 Claims, 22 Drawing Sheets

DISPLAY DEVICE WITH ELECTRO-OPTICAL ELEMENT ACTIVATED FROM PLURAL MEMORY ELEMENTS

FIELD OF THE INVENTION

The present invention relates to a flat panel display device which is suitably realized as a liquid crystal display, an EL (Electroluminescence) display or the like display device, and particularly to a display device provided with a pixel given a memory function.

BACKGROUND OF THE INVENTION

Recently, research and development of a flat panel display device have been intensively carried out. Examples of the flat panel display device include a liquid crystal display, the EL display, an FED (Field Emission Device) display and the like. Particularly, the liquid crystal display and an organic EL display are noted as a display device for use in a mobile phone, a mobile personal computer and the like, taking advantage of their light weight and low power consumption. On the other hand, as those portable devices are getting equipped with more functions, there is an increasing demand for not only a power-use battery of higher capacity and also a display device of lower power consumption for attaining as long working duration as possible.

Japanese Unexamined Patent Publication No. 194205/1996 (Tokukaihei 8-194205 published on Jul. 30, 1996) is a typical example of prior art, which discloses a method to reduce power consumption of a display device. With this method, in order to perform gray-scale display with low power consumption, each pixel is provided with a memory function; switching a reference voltage, which matches the storage content of the pixel, stops periodical rewriting in the case of displaying an identical image, thereby reducing power consumption of a driving circuit.

More specifically, as shown in FIG. 17, pixel electrodes 1 are arranged in a matrix on a first glass substrate. Between the pixel electrodes 1, scanning lines 2 are disposed in a lateral direction, and signal lines 3 are disposed in a longitudinal direction. Furthermore, reference lines 4 are disposed parallel with the scanning lines 2. In a portion enclosed by the scanning lines 2 and the signal lines 3, a memory element 5 is provided. A switching element 6 is disposed linking the memory element 5 and the pixel electrode 1.

The scanning lines 2 are selectively controlled by a scanning line driver 7 every vertical period, while the signal lines are collectively controlled by a signal line driver 8 every horizontal period. The reference lines 4 are collectively controlled by a reference line driver 9. Above the first glass substrate, a second glass substrate is provided in such a manner that the second glass substrate faces the first glass substrate with a predetermined distance therebetween. The second glass substrate has counter electrodes on a surface that faces the first glass substrate. Further, the first and second glass substrates seal a liquid crystal in between. The liquid crystal, which is an electro-optical element, is used as a display material.

FIG. 18 is a circuit diagram illustrating in detail an arrangement of each pixel portion shown in FIG. 17. In a portion enclosed by the scanning lines 2 and the signal lines 3 that are disposed to intersect at right angles, the memory element 5 for storing binary data is provided. Information stored in the memory element 5 is outputted via the 3-terminal switching element 6 made of a TFT. The switching element 6 has a control input terminal which receives output from the memory element 5. One end of the switching element 6 receives a reference voltage Vref of the reference line 4, and the other end receives a common voltage Vcom of the counter electrode 11 from the pixel electrode 1 via a liquid crystal layer 10 in between. In this manner, a resistance across the switching element 6 is controlled in accordance with output from the memory element 5, thereby adjusting a bias condition of the liquid crystal layer 10.

In the arrangement of FIG. 18, the memory element 5 is provided with two-stage inverters 12, 13, each made of a poly-Si TFT, and a memory circuit subjected to positive feedback, that is, a static memory element. When the scanning line 2 is selected because of High level of its scanning voltage Vg, a TFT 14 is brought into conduction ("ON", hereinafter), so that a signal voltage Vsig from the signal line 3 is inputted to a gate terminal of the inverter 12 via the TFT 14. The output of the inverter 12 is inverted by the inverter 13, then, inputted again to the gate terminal of the inverter 12. In this manner, data fed to the inverter 12 when the TFT 14 is ON is, with the same polarity, fed back to the inverter 12, and held until the TFT 14 is turned ON again.

Further, another arrangement in which a static memory element is provided in each pixel by using the poly-Si TFT, as with the foregoing arrangement, is disclosed in another prior art document, i.e., Japanese Unexamined Patent Publication No. 148687/1990 (Tokukaihei 2-148687 published on Jun. 7, 1990; JP Patent No. 2729089). FIG. 19 is a circuit diagram showing an arrangement of each pixel portion of the foregoing prior art. According to the prior art, each pixel is controlled by a plurality of memory cells m1, m2 to mn (in FIG. 19, n=4), a constant current circuit 21 and data of the respective memory cells m1 to mn. The pixel includes FETs q1 to qn which produce a reference current of the constant current circuit 21, and an organic EL element 22 which is driven by a current from the constant current circuit 21. The memory cells m1 to mn corresponding to the same pixel share a feed of a row electrode control signal vl, and are respectively fed n-bit column electrode control signals bi to bn.

The constant current circuit 21 is a current mirror circuit using FETs 23, 24. Therefore, a current passing through the organic EL element 22 is determined by the reference current that is the sum total of currents passing through the FETs q1 to qn which are connected parallel to one another. Furthermore, a current passing through the FETs q1 to qn is determined by data stored in the memory cells m1 to mn.

Each of the memory cells m1 to mn is arranged, for example, as shown in FIG. 20. More specifically, each of the memory cells m1 to mn includes an input inverter 25, a storage inverter 26, a feedback inverter 27, and MOS transmission gates 28, 29 for controlling, in response to the row electrode control signal vl and output from the input inverter 25, by determining which to do, inputting the column electrode control signals b1 to bn, or feeding back output from the feedback inverter 27, with respect to the gate of the storage inverter 26. In this manner, the foregoing is a static memory element arrangement such that output from the storage inverter 26 is fed back to the gate of the storage inverter 26 via the feedback inverter 27 and the MOS transmission gate 29.

Further, yet another prior art document is Japanese Unexamined Patent Publication No. 227608/2000 (Tokukai 2000-227608 published on Aug. 15, 2000) which discloses such a circuit configuration of a liquid crystal display device that an image memory is provided outside a display section. FIG. 21 is a block diagram showing a display substrate of the prior art. According to the prior art, a display section 31 is connected to an image memory 33 via a line buffer 32 in between. The image memory 33 shows an arrangement of a random access memory, in which memory cells are aligned in a matrix, and has a bit map arrangement in which address space is the same as that of a pixel of the display section 31.

An address signal 34 is inputted to a memory line selection circuit 36 and a column selection circuit 37 via a memory control circuit 35. A memory cell which was specified by the address signal 34 is selected by a column line and a row line, though not shown, and display data 38 is written into the memory cell thus selected. The display data 38 thus written is then outputted, as a line portion of data including a selection pixel, to the line buffer 32. The line buffer 32 is connected to signal wiring of the display section 31. Therefore, the read-out display data 38 is outputted to the signal wiring, though not shown.

Meanwhile, the address signal 34 is also inputted to an address line conversion circuit 39. Therefore, of all line selection wires of the display section 31, which are not shown, a line selection wire which is obtained by converting the address signal 34 is selected by a display line selection circuit 40, and a selection voltage is applied accordingly. Such operation causes the display data 38 to be fed from the image memory 33 to the display section 31.

FIG. 22 is a circuit diagram showing an example of a circuit configuration of each pixel pertaining to the display section 31. Selection of a line selection wire 41 made by the display line selection circuit 40 causes the following: a control TFT 42 which is connected to the line selection wire 41 is controlled; the display data 38 fed by the line buffer 32 via a signal wire 43 is stored by a capacitor 45 which is provided between a common wire 44 and the control TFT 42; and a terminal voltage of the capacitor 45 controls a driving TFT 46 to be ON or OFF. A determination of a conduction state of the driving TFT 46 being ON or OFF further determines in what manner a voltage from a liquid crystal reference wire 48 is applied to a pixel electrode 47: directly, or indirectly via a capacitor 49 provided between terminals of the driving TFT 46.

Further, FIG. 23 is a circuit diagram showing another example of a circuit configuration of each pixel pertaining to the display section 31. In this configuration, an analog switch 51 is used as a TFT for driving a liquid crystal. The analog switch 51 is made up of a p-type TFT 52 and an n-type TFT 53. In order to drive the analog switch 51, two systems of memory circuits, which respectively include a sampling capacitor 54, 55 and a sampling TFT 56, 57, are provided corresponding to the TFTs 52, 53.

The sampling TFTs 56, 57 are respectively connected to two data wires 58, 59 which have different polarities, while being connected to the same line selection wire 41. The line selection wire 41 controls ON or OFF of the sampling TFTs 56, 57, and voltages D, /D of the data wires 58, 59 are respectively stored in the sampling capacitors 54, 55. Note that, this Publication also discloses that (i) the voltages D, /D which have different polarities and used to drive the analog switch 51 are not stored by providing two systems of memory circuits unlike the foregoing, but are produced by an inverter circuit inside a pixel, and (ii) the memory circuit may be configured on the display section 31 by adopting a configuration of a memory circuit used for a semiconductor, in which a TFT is used.

Thus, the Publication 227608/2000 discloses an arrangement of a polysilicon TFT substrate having the image memory 33 in addition to the display section 31 for a liquid crystal display use.

However, according to prior art disclosed in the Publication 194205/1996, as shown in FIG. 18, one pixel is made up of a liquid crystal layer 10, a liquid crystal driving switching element 6 and a 1-bit memory element 5. This raises a problem that multi-gray-level display of not less than 3 gray-levels cannot be performed, though black and white binary display per liquid crystal element can be performed.

Likewise, even in the prior art disclosed in the Publication 227608/2000, as shown in FIG. 22, one pixel is provided only with a liquid crystal element and a 1-bit memory element made up of the capacitor 45. This raises a problem that not more than black and white binary display per liquid crystal element can be performed.

In this respect, in the prior art of the Publication 148687/1990, as shown in FIG. 19, one pixel is made up of the organic EL element 22, the current mirror circuit 21 and the plurality of memory cells m1 to mn. Therefore, it is possible to realize multi-gray-level display in accordance with the number n of the memory cells by rewriting a condition of the memory cells m1 to mn.

However, the arrangement of FIG. 19 requires the column electrode control signals b1 to bn, corresponding to data wires, the number of which is the same as the number n of the memory cells necessary for the multi-gray-level display. Therefore, as levels of gray are increased in the multi-gray-level display, pixels are covered with more wires. This raises a new problem that an area to create a memory cell and the like narrows.

Further, in the arrangement disclosed in the Publication 227608/2000, a 1-scanning line portion of data is read out of the image memory 33 in parallel, then, transmitted to the line buffer 32. Thus transmitting the data in parallel from the image memory 33 to a buffer circuit (or a signal line driver) has the merit such that it does not require to take the following steps: parallel/serial conversion is performed with respect to a 1-line portion of data, and the data, now serial data, is transferred through the inside of a shift register, not shown, of the signal line driver 8 of FIG. 17, then, the serial/parallel conversion is performed again with respect to the transferred data. This arrangement can realize low power consumption accordingly.

However, in the case where multi-gray-level display of not less than 3 gray-levels per pixel is performed according to this arrangement, it should be arranged such that data which is read out of the image memory 33 is converted to an analog voltage in a D/A converter provided inside the signal line driver 8. This raises a problem that large power consumption is required by D/A conversion.

Furthermore, even in the arrangement of the Publication 148687/1990, the reference current that is produced by the FETs q1 to qn and then passes through the side of the FET 23 of the current mirror circuit 21 becomes unwanted. Regarding the current mirror circuit 21 as a kind of D/A converter, there arises, again, the problem of large power consumption due to D/A conversion.

SUMMARY OF THE INVENTION

An object of the present invention is to provide a display device capable of reducing the number of wires in a display area while reducing power consumption when realizing multi-gray-level display.

In order to attain the foregoing object, a display device according to the present invention includes: electro-optical elements, each of which is disposed in each area arranged in a matrix; active elements (A), each of which is provided in the each area; and memory elements, each of which captures data from a signal line via the active element (A) in between, and activates the electro-optical element for display by output, wherein: two or more of the memory elements associated with each electro-optical element are provided with respect to each of the signal lines, and the each electro-optical element is activated for display by output, in part or in full, from the two or more memory elements which are provided in association with the electro-optical element.

With this arrangement, in the display device in which storage holding operation is performed for each electro-optical element by allowing the memory element to capture data from the signal line via the active element (A) while the active element (A) is selected by a selection line, and applying a voltage of a reference line to the electro-optical element in accordance with the storage contents of the memory element; and power consumption is reduced in a signal line driving circuit by preventing rewriting of the identical data, it is arranged that, when realizing multi-gray-level display and/or display of different images, the number of the memory elements with respect to each of the signal lines, which are formed in association with each electro-optical element, is the same as the number of bits which are associated with gray-levels or images for display, which are, for example, 3 memory elements for 8 gray-levels. Further, the electro-optical element is activated for display by the output, in part or in full, of the memory element.

Consequently, in the case of using partial output, by switching output according to the weight of the bit, a time sequential digital gray-scale control can be performed. Also, different display can be performed by using the partial output and the other output. For example, in n-bit data, it is possible to display $2^n$ gray-level image, and n pieces of 2-gray-level (1-bit gray-scale) image by switching, and also, to switch between $2^{n-1}$ gray-level display and 2 gray-level (1-bit gray-scale) display. On the other hand, in the case of using the whole output at a time, it is possible to perform analog gray-scale control by an additional voltage or current of output of the respective bits.

Accordingly, using the shared signal line, data of each bit is captured by the associated memory element, and bit selection lines which respectively select the bits are routed to be shared by active elements having the equivalent bit order to each other, thereby reducing the number of wires. Furthermore, using multi-bit data, the electro-optical element is activated according to a time-ratio gray-scale method, thereby reducing power consumption required for D/A conversion.

Further, in order to attain the foregoing object, another display device according to the present invention includes: active elements (A) connected to selection lines and signal lines; memory elements, each of which captures data from the signal line via the active element (A) in between; electro-optical elements, each of which performs display in accordance with storage contents of the memory element; and active elements (B), each of which is provided in association with each memory element, wherein the number of memory elements, which are provided in association with the respective electro-optical elements and with respect to each of the signal lines, is the same as the number of bits which are associated with at least a portion of desired gray-levels and/or images for display, and the display device further comprising bit selection lines which are routed so as to be shared by control input terminals of the active elements (B) having the equivalent bit order to each other, either one of the bit selection lines being selected at a time for each bit order, the bit selection lines activating the active elements (B) to store the data in the associated memory element via the active element (A) during a selection period of the selection line, and to output the data stored in the associated memory element with respect to the electro-optical element during a non-selection period of the selection line.

With this arrangement, in the display device in which storage holding operation is performed for each electro-optical element by allowing the memory element to capture data from the signal line via the active element (A) while the active element (A) is selected by a selection line, and applying a voltage of a reference line to the electro-optical element in accordance with the storage contents of the memory element; and power consumption is reduced in a signal line driving circuit by preventing rewriting of the identical data, it is arranged that, when realizing multi-gray-level display and/or display of different images, the number of the memory elements with respect to each of the signal lines, which are formed in association with each electro-optical element, is the same as the number of bits which are associated with at least a portion of gray-levels or images for display. For example, when 8 gray-levels are desired, two memory elements are provided in association with the respective electro-optical elements, then, the total number of the memory elements is adjusted to 3 in accordance with the respective electro-optical elements by, for example, providing one more memory element in an external RAM.

Meanwhile, in association with each memory element, an active element is provided to link the active element (A) and the memory element associated with the electro-optical element. During a selection period of the selection line, the bit selection line selects either one of the active elements (B), thereby storing data of each bit in the associated memory element. On the other hand, during a non-selection period of the selection line, the bit selection line selects either one of the active elements (B), thereby outputting the data stored in the associated memory element to the electro-optical element.

More specifically, for example, when realizing the multi-gray-level display, assuming that first to third bits of 3-bit data are equally 1, the data of 1 from the memory element associated with the first bit is fed to the electro-optical element via the active element (B) only for the duration of unit period T. Next, the data of 1 from the memory element associated with the second bit is fed to the electro-optical element via the active element (B) only for the duration of period 2T. Thereafter, the data of 1 from the memory element associated with the third bit is fed to the electro-optical element via the active element (B) only for the duration of period 4T. In that case, a voltage of the reference line is applied to the electro-optical element when a gray-level is 7 of 0–7 of the 8 gray-levels, thereby realizing time sequential digital multi-gray-level display.

Further, as discussed, in the case where the active element (B) switches the partial output of the memory element, it is possible to display different images by using the partial output and the remainder of the output. More specifically, in the case of n-bit data, display is not limited to the foregoing display of an image of $2^n$ gray-level. For example, it is possible to display a simple moving image by switching n pieces of 2-gray-level (1-bit gray-scale) images, and/or switch between display of a $2^{n-1}$ gray-level image and display of a 2-gray-level (1-bit gray-scale) image.

Accordingly, using the shared signal line according to time-division, multi-bit data is captured by the respective memory elements one after another, and bit selection lines are routed to be shared by active elements having the equivalent bit order to each other, thereby reducing the number of wires. Further, using the multi-bit data, the electro-optical element is activated according to the time-ratio gray-scale method, thereby reducing power consumption required for D/A conversion. Moreover, when switching different images for display, by temporarily writing data into the memory element, operation of an external CPU or the like is no longer required, thereby attaining low power consumption.

Further, in order to attain the foregoing object, another display device according to the present invention includes: active elements (A) connected to selection lines and signal lines; memory elements, each of which captures data from the signal line via the active element (A) in between while the active element (A) is selected by the selection line; electro-optical elements, each of which performs display in accordance with storage contents of the memory element; and active elements (C), each of which is provided in association with the each memory element between the memory element and the electro-optical element, wherein the number of the memory elements, which are provided in association with the respective electro-optical elements and with respect to each of the signal lines, is the same as the number of bits which are associated with at least a portion of desired gray-levels and/or images for display, the memory elements are respectively provided in association with the different selection lines via the different active elements (A), the display device further comprising bit selection lines which are routed so as to be shared by control input terminals of the active elements (C) having the equivalent bit order to each other, either one of the bit selection lines being selected at a time for each bit order, the bit selection lines activating the active elements (C) to output the data stored in the associated memory element with respect to the electro-optical element.

With this arrangement, in the display device in which storage holding operation is performed for each electro-optical element by allowing the memory element to capture data from the signal line via the active element (A) while the active element (A) is selected by a selection line, and applying a voltage of a reference line to the electro-optical element in accordance with the storage contents of the memory element; and power consumption is reduced in a signal line driving circuit by preventing rewriting of the identical data, it is arranged that, when realizing multi-gray-level display and/or display of different images, the number of the memory elements with respect to each of the signal lines, which are formed in association with each electro-optical element, is the same as the number of bits which are associated with gray-levels or images for display, which are, for example, 3 memory elements for 8 gray-levels.

Meanwhile, the active elements (A) and their selection lines are provided in association with the respective memory elements, and the active elements (C), either one of which is selected by the bit selection line at a time, are provided to link the respective memory elements and electro-optical elements, thereby realizing time sequential digital multi-gray-level display and/or displaying different images.

Accordingly, using the shared signal line according to time-division, multi-bit data is captured by the respective memory elements one after another, and bit selection lines are routed to be shared by active elements having the equivalent bit order to each other, thereby reducing the number of wires. Further, using the multi-bit data, the electro-optical element is activated according to the time-ratio gray-scale method, thereby reducing power consumption required for D/A conversion.

Further, in order to attain the foregoing object, another display device according to the present invention includes: active elements (A) connected to selection lines and signal lines; memory elements, each of which captures data from the signal line via the active element (A) in between while the active element (A) is selected by the selection line; and electro-optical elements, each of which performs display in accordance with storage contents of the memory element, wherein: the number of the memory elements, which are provided in association with the respective electro-optical elements and with respect to each of the signal lines, is the same as the number of bits which are associated with at least a portion of desired gray-levels for display, and the memory elements are respectively provided in association with the different selection lines via the different active elements (A) in between, and the respective electro-optical elements are activated for display by total output of a plurality of the memory elements which are formed in association with the electro-optical elements.

With this arrangement, in the display device in which storage holding operation is performed for each electro-optical element by allowing the memory element to capture data from the signal line via the active element (A) while the active element (A) is selected by a selection line, and applying a voltage of a reference line to the electro-optical element in accordance with the storage contents of the memory element; and power consumption is reduced in a signal line driving circuit by preventing rewriting of the identical data, it is arranged that, when realizing multi-gray-level display, the number of the memory elements with respect to each of the signal lines, which are formed in association with each electro-optical element, is the same as the number of bits which are associated with gray-levels for display. In addition, the active elements (A) and their selection lines are provided in association with the respective memory elements.

Consequently, it is possible to perform analog grayscale control by an additional voltage or current of output of the respective bits. Accordingly, using the shared signal line according to time-division, multi-bit data is captured by the respective memory elements one after another, and bit selection lines are routed to be shared by active elements having the equivalent bit order to each other, thereby reducing the number of wires.

Further, in order to attain the foregoing object, another display device according to the present invention includes: active elements (A) connected to selection lines and signal lines; memory elements, each of which captures data from the signal line via the active element (A) in between; electro-optical elements, each of which performs display in accordance with storage contents of the memory element; and active elements (B), each of which is provided in association with each memory element, wherein the number of the memory elements, which are provided in association with the respective electro-optical elements and with respect to each of the signal lines, is the same as the number of bits which are associated with at least a portion of desired gray-levels for display, the display device further comprising bit selection lines which are routed so as to be shared by control input terminals of the active elements (B) having the equivalent bit order to each other, either one of the bit selection lines being selected at a time for each bit order, the bit selection lines activating the active elements (B) to store data in the associated memory element via the active element (A) during a selection period of the selection line, the respective electro-optical elements being activated for display by total output of a plurality of the memory elements which are formed in association with the electro-optical elements.

With this arrangement, in the display device in which storage holding operation is performed for each electro-optical element by allowing the memory element to capture data from the signal line via the active element (A) while the active element (A) is selected by a selection line, and applying a voltage of a reference line to the electro-optical element in accordance with the storage contents of the memory element; and power consumption is reduced in a signal line driving circuit by preventing rewriting of the identical data, it is arranged that, when realizing multi-gray-level display, the number of the memory elements with respect to each of the signal lines, which are formed in association with each electro-optical element, is the same as the number of bits which are associated with gray-levels and/or images for display. In addition, in association with the respective memory elements, the active elements (B) are provided to link the respective active elements (A) and memory elements which are in turn respectively associated with the electro-optical elements. By allowing the bit selection line to select either one of the active elements (B) at a time, data can be stored in the associated memory element.

Consequently, it is possible to perform analog gray-scale control by an additional voltage or current of output of the respective bits. Accordingly, using the shared signal line according to time-division, multi-bit data is captured by the respective memory elements one after another, and bit selection lines are routed to be shared by active elements having the equivalent bit order to each other, thereby reducing the number of wires.

Additional objects, features, and strengths of the present invention will be made clear by the description below. Further, the advantages of the present invention will be evident from the following explanation in reference to the drawings.

DESCRIPTION OF THE EMBODIMENTS

First Embodiment

The following will describe the First Embodiment of the present invention with reference to FIGS. 1 to 4.

Figure 1:
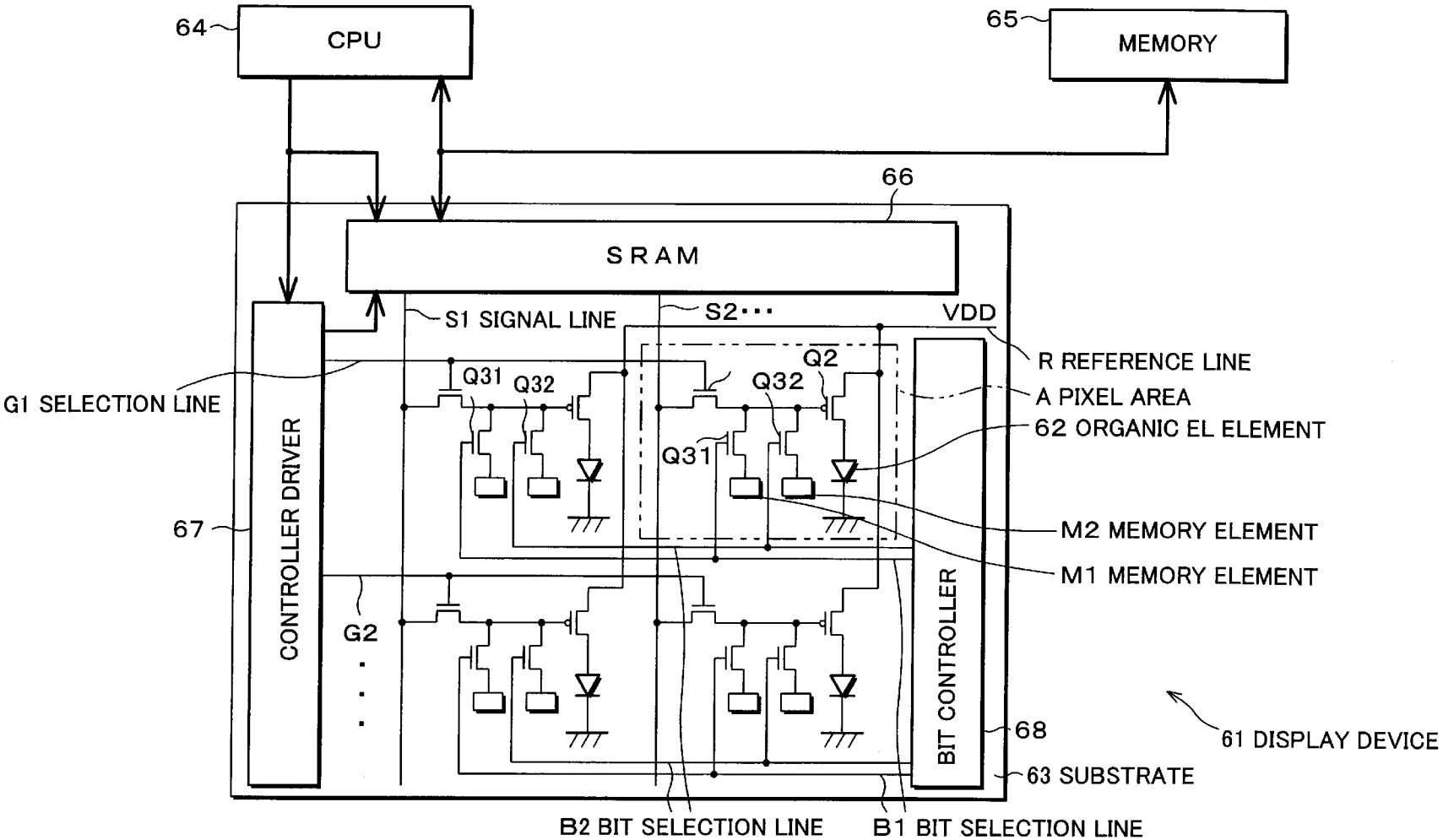
FIG. 1 is a diagram schematically showing an arrangement of a display device according to a First Embodiment of the present invention.

FIG. 1 is a diagram schematically showing an arrangement of a display device 61 according to the First Embodiment of the present invention. The display device 61, though being an EL display using an electro-optical element as an organic EL element 62, may of course be realized using a liquid crystal element or an FED element. Note that, a TFT (Thin Film Transistor) element which is formed on a substrate 63 in the present arrangement may be produced in a CGS (Continuous Grain Silicon) TFT manufacturing process, a commonly used poly-Si TFT process or the like. The CGS TFT manufacturing process is taught, for example, in Japanese Unexamined Patent Publication No. 301536/1998 (Tokukaihei 10-301536 published on Nov. 13, 1998) and the like.

In the display device 61, roughly, a CPU (Central Processing Unit) 64 communicates data with a memory 65 serving as a flash memory and an SRAM (Static Random Access Memory), thereby storing data for display in an SRAM 66 on the substrate 63. The data stored in the SRAM 66 is written, and periodically read out, when given an instruction from a controller driver 67 which is under the control of the CPU 64, thereafter being stored in a memory element M formed within each pixel area A. Further, that a voltage VDD of a reference line (power line) R is fed to the organic EL element 62 in accordance with the data stored in the memory element M enables each pixel to obtain power necessary for storage holding operation. Further, rewriting of the same data is prevented, thereby saving power in the SRAM 66 which is a signal line driving circuit. Likewise, power is saved by switching OFF the power of the CPU 64.

From the controller driver 67 run selection lines (gate signal lines) Gi (i=1, 2 to m; whenever collectively referred to, they are hereinafter denoted with a reference symbol "G"). From the SRAM 66 run signal lines (data signal lines) Sj (j=1, 2 to n; whenever collectively referred to, they are hereinafter denoted with a reference symbol "S"). In a portion enclosed by the selection and signal lines, an n-type TFT Q1 which is the first active element (active element A) is provided. Further, the controller driver 67 applies a selection voltage to the selection line G. The TFT Q1, a gate of which is connected to the selection line G, applies data, which is outputted from the SRAM 66 to a signal line S, to the memory element M. Further, output from the memory element M is fed to a gate of a p-type TFT Q2 which forms an electro-optical element together with the organic EL element 62. The TFT Q2 applies a voltage VDD of the reference line R to the organic EL element 62.

Note that, the memory element M is realized using a static memory, which will be discussed below. In that case, assuming the SRAM 66 to be a buffer to adjust a data transfer rate of data outputted from the CPU 64 and a data transfer rate of data transmitted to the memory element M disposed in the pixel area A, the SRAM 66 is required only to temporarily hold data. Accordingly, a DRAM configuration may be adopted instead of the SRAM 66. In that case, together with data to be stored in the memory element M, data indicative of information on updated data, i.e., with which pixel the updated data is associated, is stored in the DRAM configuration, thereby attaining an arrangement in which only the data of the memory element M associated with the updated data is rewritten.

More specifically, the data of the memory element M disposed in the pixel area A of the display device 61 is rewritten via the signal line S or the like. However, since floating capacitance of the signal line S or the like is commonly larger than that of a general RAM, a rewriting rate in this case becomes slower than that of the general RAM. Therefore, in order to allow the data from the CPU 64 to be held temporarily, a RAM equivalent to the general RAM is provided outside the display area. Here, a RAM outside the pixel area A may have the DPAM configuration.

Further, the RAM provided outside the pixel area, as discussed below, plays a role of storing data which failed to be written into the memory element M in the pixel area A. For example, in the case where the desired gray-scale for display is a 6-bit gray-scale, and when only a 4-bit gray-scale is available to a pixel, data of the other 2-bit gray-scale is provided in the RAM outside the pixel area A.

Furthermore, as discussed below, in the case where a plurality of images are to be displayed by switching, the number of necessary memory elements increases. In that case, as with the foregoing, memory data that could not be provided within the pixel area A may be provided in the RAM outside the pixel area A. Namely, display can be attained as follows: display data is exchanged between the memory element M in the pixel area A and the RAM outside the pixel area A; here, generally displayed is the memory data within the pixel area A, and when a screen is switched to another, the RAM data outside the pixel area A is moved to the memory element M within the pixel area A, (and the memory data within the pixel area A is returned to the RAM outside the pixel), thereby performing display.

Further, the SRAM 66, the controller driver 67, and the CPU 64 may integrally be formed on the substrate 63. In that case, it is equally possible if they are formed on the substrate 63 in the CGS TFT manufacturing process while preparing the substrate 63, or if such an integrated circuit is created in a monocrystalline semiconductor manufacturing process and is thereafter mounted on the separately prepared substrate 63. Further, in the latter case in which the integrated circuit created in the monocrystalline semiconductor manufacturing process is mounted on the separately prepared substrate 63, the integrated circuit may be mounted directly on the substrate 63. It is alternatively possible that the integrated circuit is temporarily mounted on a tape, which is given wiring with a copper foil pattern by TAB (Tape Automated Bonding) technology, thereafter bonding a TCP (Tape Carrier Package) thus prepared to the substrate 63.

A significant arrangement according to the present invention is that there are provided (i) memory elements M as many as bits which correspond to gray-levels used for display when performing multi-gray-level display, (ii) memory elements M as many as bits which are necessary for a plurality of desired images for display, or (iii) the same/smaller number of memory elements M (in FIG. 1, for simplicity, two memory elements M are shown with reference symbols M1 and M2) as/than the total number of bits including the bits required in (i) and the bits required in (ii) in combination. In the case where the number of the memory elements M to be formed within each pixel area A is less than the required number, the remainder of the required memory elements M can be provided within the SRAM 66, and data may be exchanged between the pixel area A and the SRAM 66 as required. Explanation below assumes the multi-gray-level display, and the display of a plurality of images will be discussed later.

In an arrangement shown in FIG. 1, memory elements M1, M2 are provided in association with a line connecting between the TFTs Q1, Q2. Then, TFTs Q31, Q32, which are second active elements (active elements B), are provided in such a manner that links the line and the memory elements M1, M2 so that they correspond to the memory elements M1, M2, respectively. Further, in order to select either one of the TFTs Q31, Q32 at a time, selection lines B1, B2 and a bit controller 68 which generates a selection voltage in the bit selection lines B1, B2 are provided. The bit controller 68 may integrally be formed on the substrate 63 as with the SRAM 66 and others.

Figure 2:
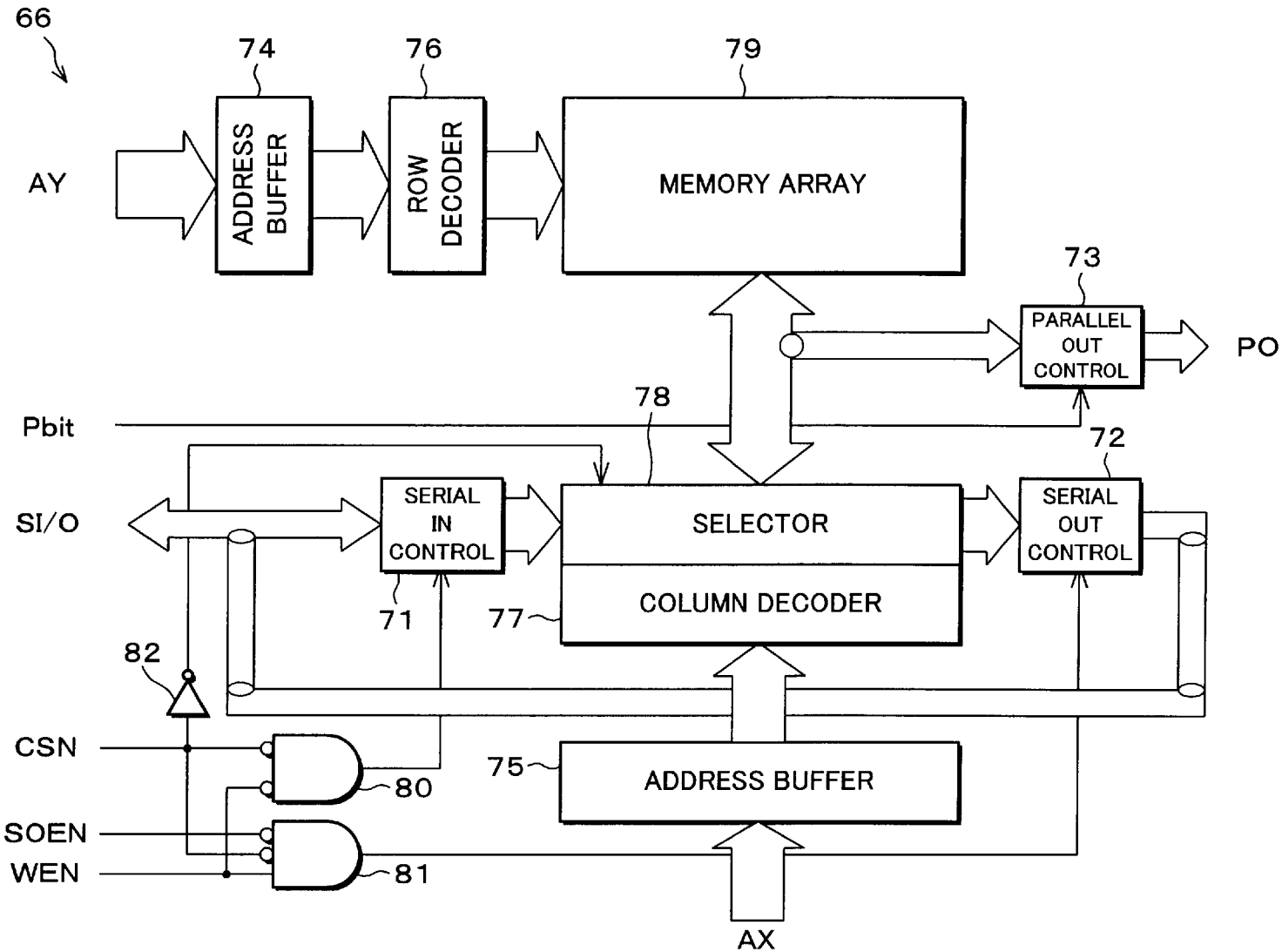
FIG. 2 is a block diagram showing one example of an arrangement of a memory element in the display device of FIG. 1.

FIG. 2 is a block diagram showing an example of an arrangement of the SRAM 66. The SRAM 66 includes a parallel OUT control circuit 73 separately from a serial I/O port which is made up of a serial IN control circuit 71 and a serial OUT control circuit 72 with respect to the CPU 64. The parallel OUT control circuit 73 is a port to output, in parallel, data corresponding to pixels of one line (1, 2 to m) on a side of a segment of the substrate 63 in association with each signal line S. The parallel OUT control circuit 73 further has three ports R, G, B for each pixel. Further, as in an ordinary SRAM circuit, the SRAM 66 includes address buffers 74, 75, a row decoder 76, a column decoder 77, a selector 78, a memory array 79, as well as gates 80, 81 and a buffer 82 which are associated with chip select or various enable signals.

Figure 3:
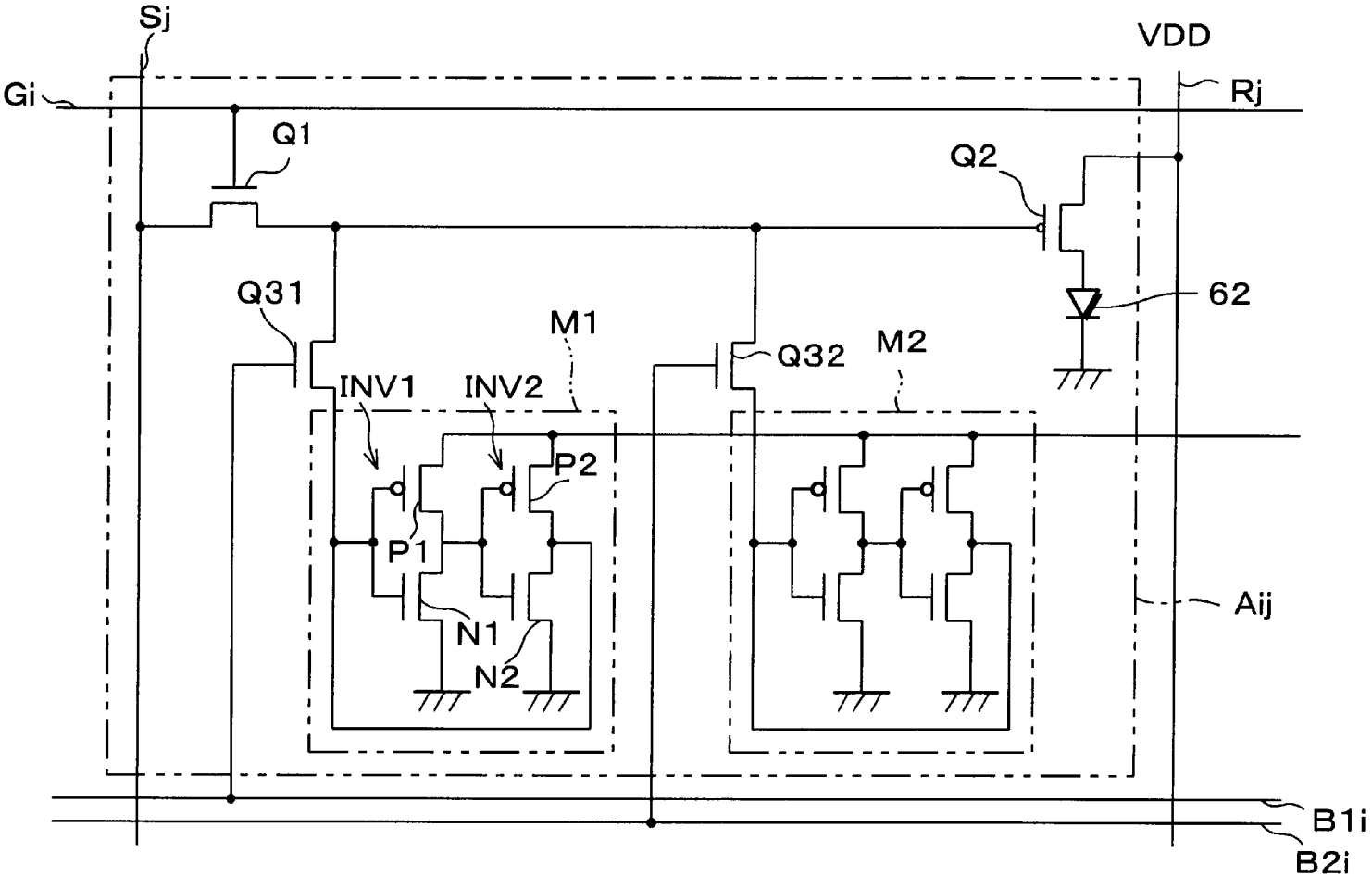
FIG. 3 is a diagram showing an electrical circuit of a pixel area so as to explain an arrangement of a memory element in the display device of FIG. 1.

FIG. 3 is an explanatory view showing an arrangement of the memory element M, which is an electrical circuit of a pixel area Aij at an arbitrarily selected i-th row and j-th column. In FIG. 3, as in FIG. 1, for simplicity, two memory elements M1, M2 are shown as the memory element M. Hereinafter, attachment letters i, j which refer to the i-th row and j-th column, respectively, are to be attached only when particularly necessary, and are otherwise omitted for ease of explanation.

The memory elements M1, M2 have a two-stage inverter arrangement in which a CMOS inverter INV1, made up of a p-type TFT P1 and an n-type TFT N1, and a CMOS inverter INV2, similarly made up of a p-type TFT P2 and an n-type TFT N2, are provided in combination. More specifically, the memory elements M1 and M2 have an SRAM configuration in which the TFTs Q31, Q32 are connected to an input terminal of the inverter INV1; an output terminal of the inverter INV1 is connected to an input terminal of the inverter INV2; and an output terminal of the inverter INV2 is connected to the input terminal of the inverter INV1 and the TFTs Q31, Q32.

Accordingly, data from the SRAM 66 is inputted to the input terminal of the inverter INV1 via the TFT Q1 and the TFTs Q31, Q32, then, inverted by the inverter INV1 and inverted in turn by the inverter INV2. After positive feedback to the input terminal of the inverter INV1, self-holding operation is performed, and output resulted therefrom is fed, via the TFTs Q31, Q32, to the TFT Q2 that makes up an electro-optical element.

Note that, output impedance of the inverter INV2 making up the memory elements M1, M2 is set higher than impedance of a signal which is outputted from the SRAM 66 via the signal line S and TFTs Q1, Q31, Q32.

Alternatively, a separate active element (not shown) is inserted between the output terminal of the inverter INV2 and the input terminal of the inverter INV1, and data (a signal) from the SRAM 66 is fed via the signal line S and the TFTs Q1, Q31, Q32. At that time, output from the inverter INV2 is set not to return to the input terminal of the inverter INV1.

With this arrangement, an input voltage of the inverter INV1 can be set from the SRAM 66 irrespective of output from the inverter INV2.

Figure 4:
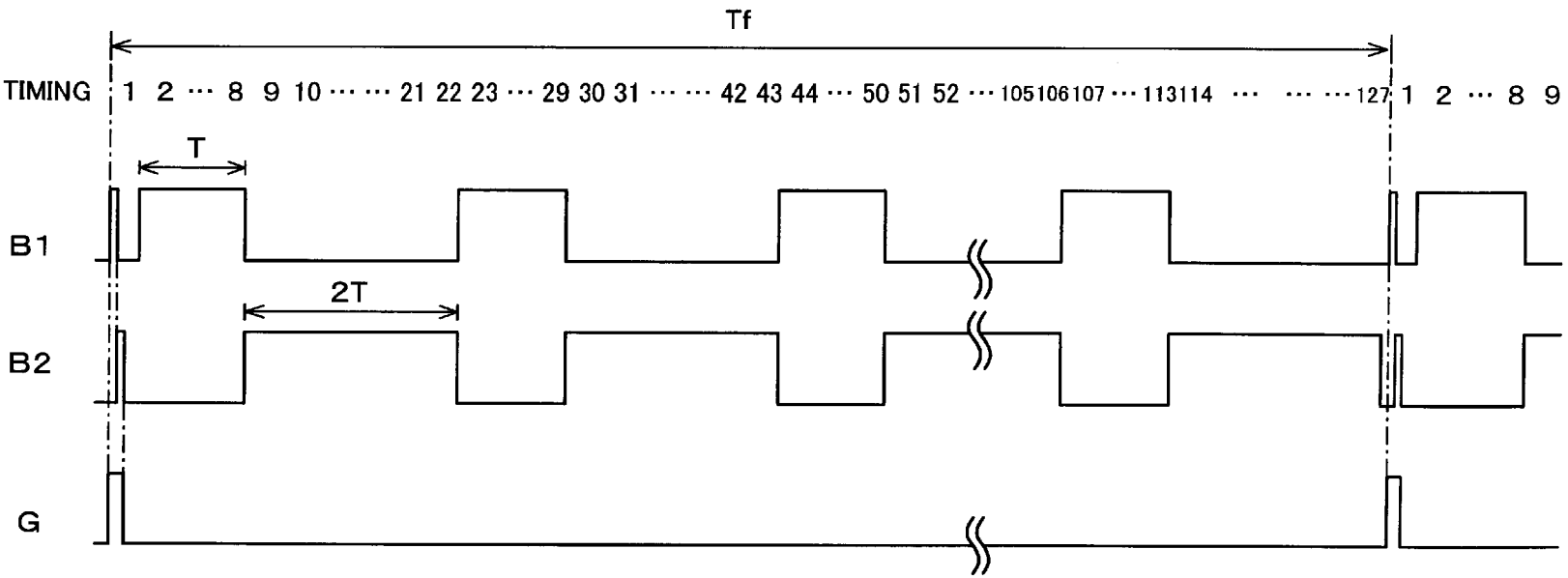
FIG. 4 is a diagram showing waveforms of signals applied to a bit selection line and a selection line in the case of the display device of FIG. 1.

FIG. 4 is a diagram showing waveforms of signals applied to the bit selection lines B1, B2 and the selection line G. In an example shown in FIG. 4, one frame period Tf is divided into 127 periods. At timing 1 for feeding data, the selection line G becomes High level (selection voltage), and the bit selection lines B1, B2 selectively rise to High level, thereby causing the data from the SRAM 66 to be captured by the respective memory elements M1, M2 via the same signal line S. The selection line G drops to Low level (non-selection voltage) and remains the same at the other timings 2 to 127 for displaying data. Also, the bit selection lines B1, B2 selectively rise to High level according to the weight proportion of the bit, thereby causing data of the respective memory elements M1, M2 to be outputted to the TFT Q2.

More specifically, according to the weight of the bit, the bit selection line B1 for unit period T is selected, whereas the bit selection line B2 for period 2T is selected. Further, in an example shown in FIG. 4, the unit period T is set to be 7/127 of one frame period Tf. Namely, in one frame period Tf, the bit selection lines B1, B2 are alternately selected six times, i.e., $(127-1)/\{(1+2)\times 7\}=6$ times.

Accordingly, as described, at timing 1, data is captured by the memory elements M1, M2. At timings 2 to 8, the bit selection line B1 is selected, and data from the memory element M1 is outputted to the TFT Q2. At timings 9 to 22, the bit selection line B2 is selected, and data of the memory element M2 is outputted to the TFT Q2. Selection is hereafter made in the same manner. For example, at timings 23 to 29, the bit selection line B1 is selected. At timings 30 to 43, the bit selection line B2 is selected. At timings 107 to 113, the bit selection line B1 is selected. At timings 114 to 127, the bit selection line B2 is selected.

Further, the selection lines G are selected one after another only for the duration of 1/127 of one frame term. In the case where the controller driver 67 monitors data transferred from the CPU 64 to the SRAM 66, and when no modifications are needed in a display image, the SRAM 66 does not output data in response to control output from the controller driver 67, thereby saving power as discussed.

Note that, even at timing 1, the respective data of the memory elements M1, M2 are outputted to the TFT Q2. Therefore, assuming that a display period is limited to timings 2 to 127, there occurs a tonal error. On the other hand, in the case where timing 1 is included in the display period, the TFT Q2 is then driven directly by data from the SRAM 66. However, in that case, writing data into the memory elements M1, M2 causes an adverse effect of voltage fluctuation. Consequently, in consideration of an effect of a period in which the selection line G is at High level, and the bit selection line B1 or B2 rises to High level, it is only required to adjust a period in which the bit selection line B1 or B2 is at High level while the selection line G is at Low level. A voltage VDD of the reference line R and a voltage of the signal line S upon selection are equally, for example, in a range between 5V and 6V.

In the display device 61 thus adopting the memory element M to save power, in order to realize multi-gray-level display, it is arranged such that memory elements M1, M2 are provided as the memory element M, the number of the memory elements being made equal to the number of bits which are required to attain a desired gray-scale for display; the TFTs Q31, Q32 are provided between the TFTs Q1, Q2 and the memory elements M1, M2, respectively; while the selection line G is selected, data of each bit is successively stored in the memory elements M1, M2 via the TFT Q1 according to time division; while the selection line G is not selected, the stored data is fed to the TFT Q2 according to the weight proportion of the bit, thereby applying a voltage VDD of the reference line R according to time division. With this arrangement, it is possible to realize digital multi-gray-level display of the electro-optical element 62.

Figure 19:
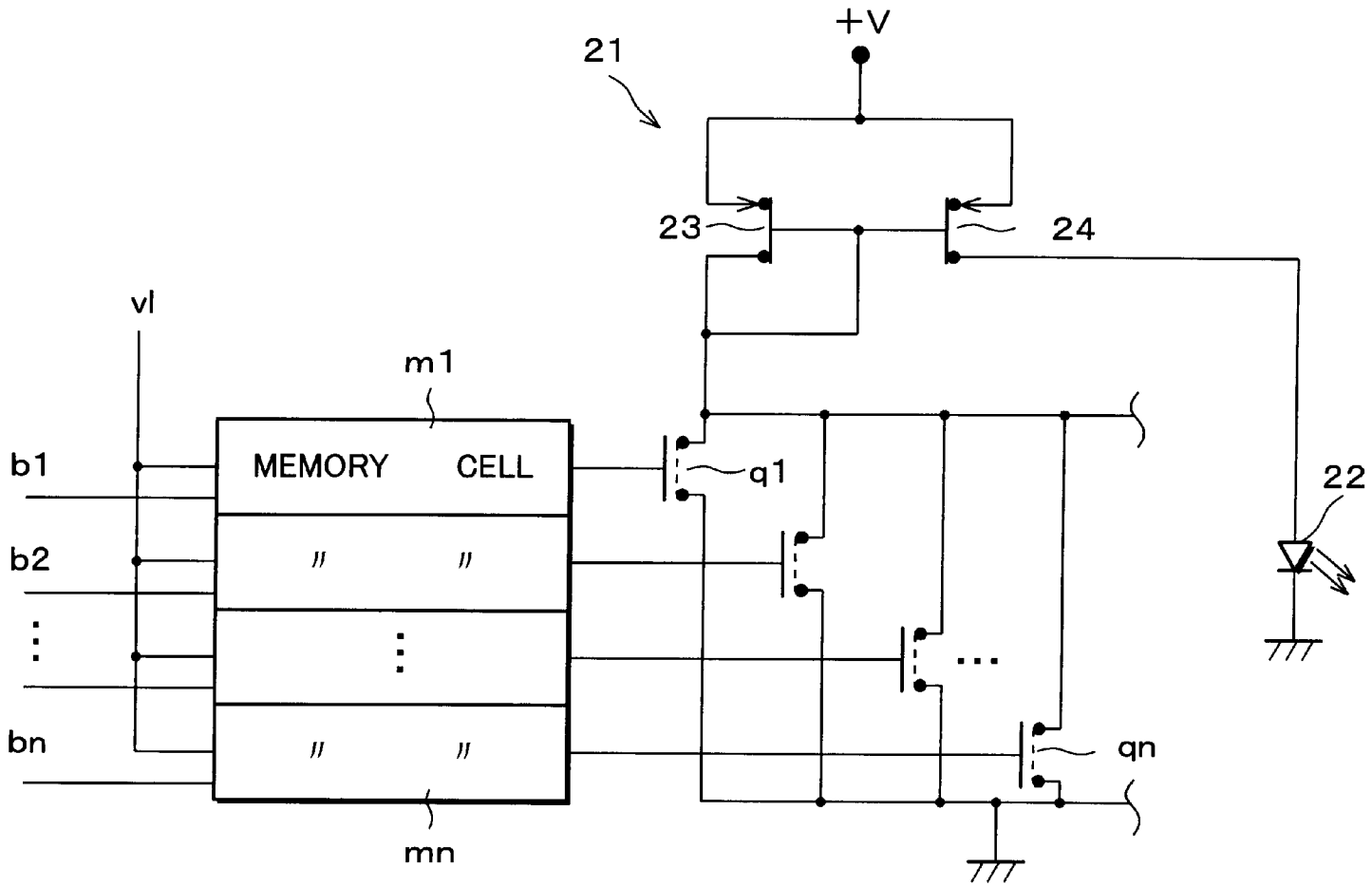
FIG. 19 is a diagram showing a configuration of each pixel portion in a display device according to other prior art.
Figure 20:
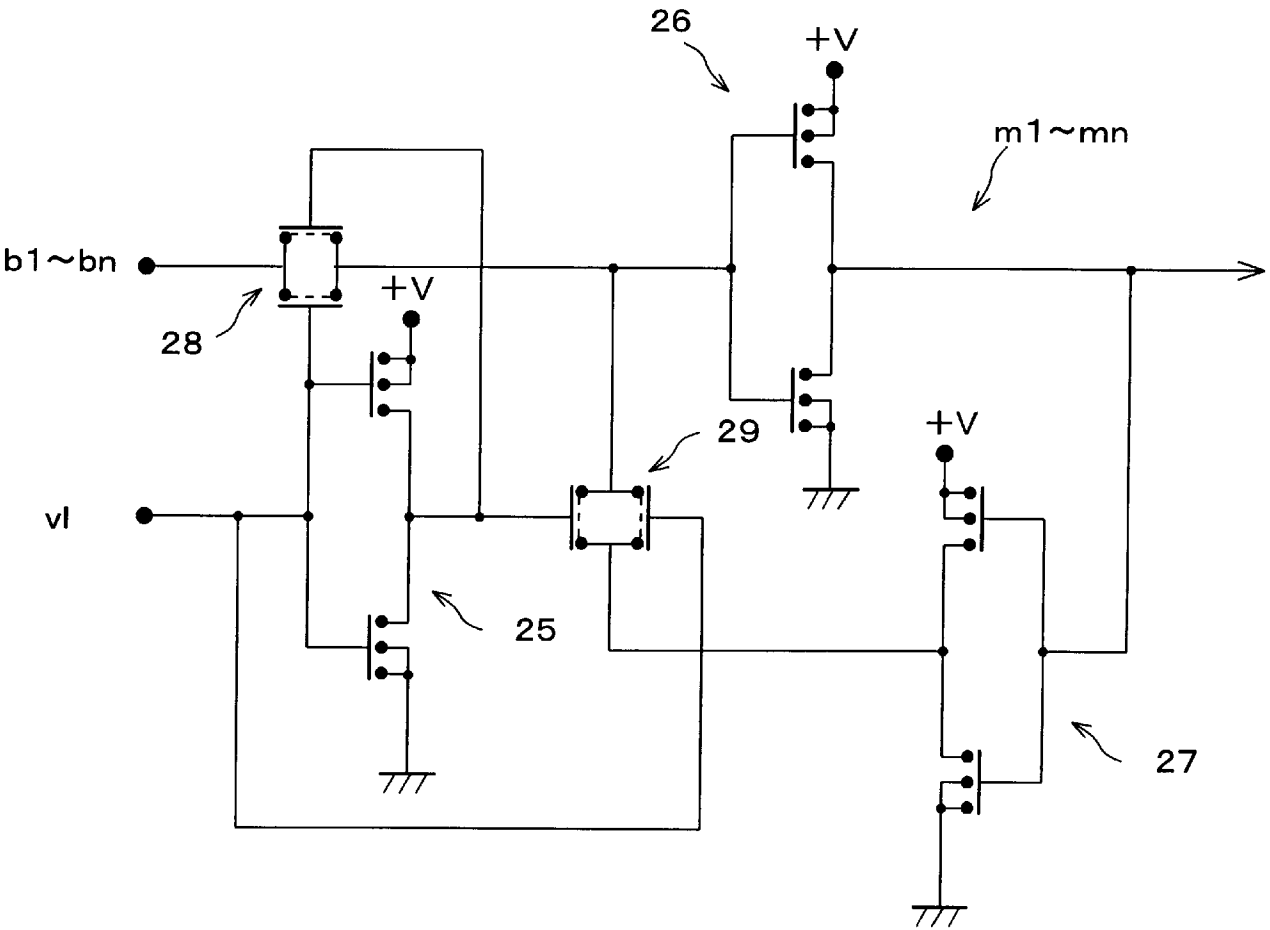
FIG. 20 is a diagram showing in detail a circuit configuration of a memory cell in the display device of FIG. 19.
Figure 21:
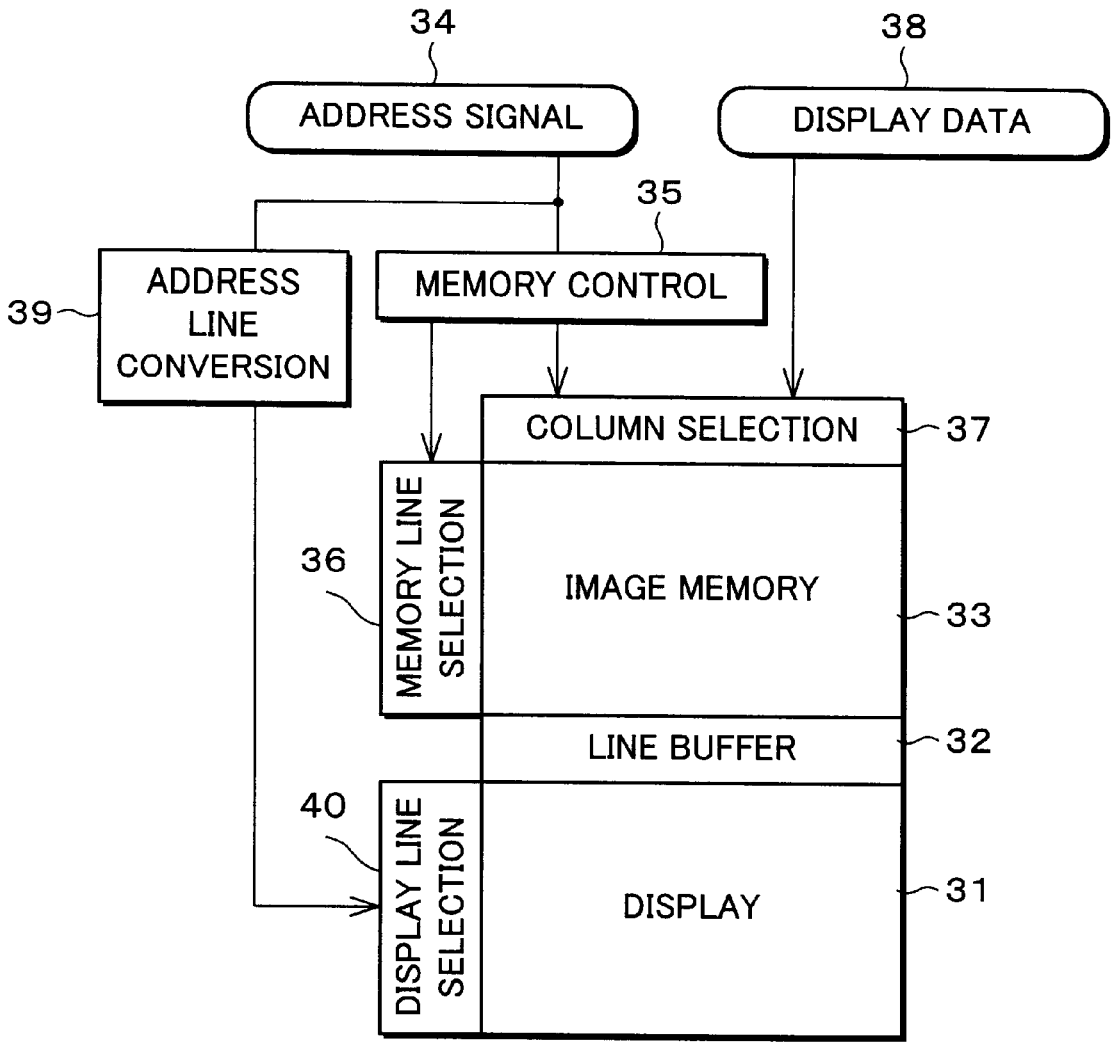
FIG. 21 is a block diagram showing an arrangement of a display device according to still other prior art.
Figure 22:
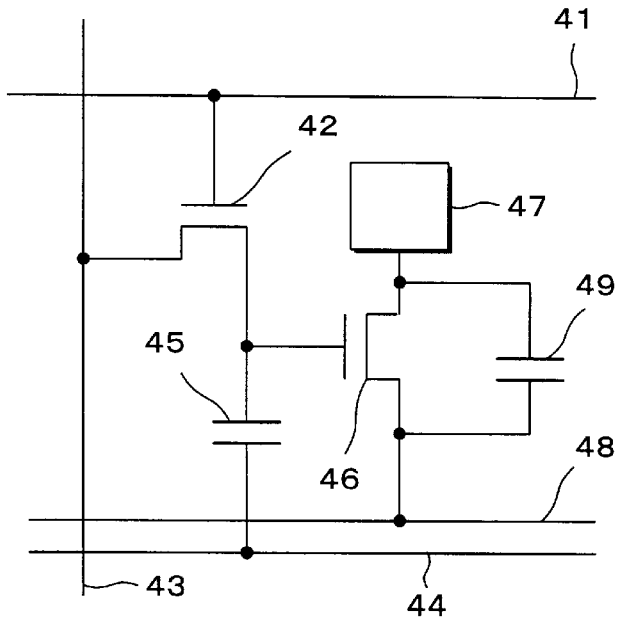
FIG. 22 is a diagram showing an example of a circuit configuration of each pixel in the display device of FIG. 21.
Figure 23:
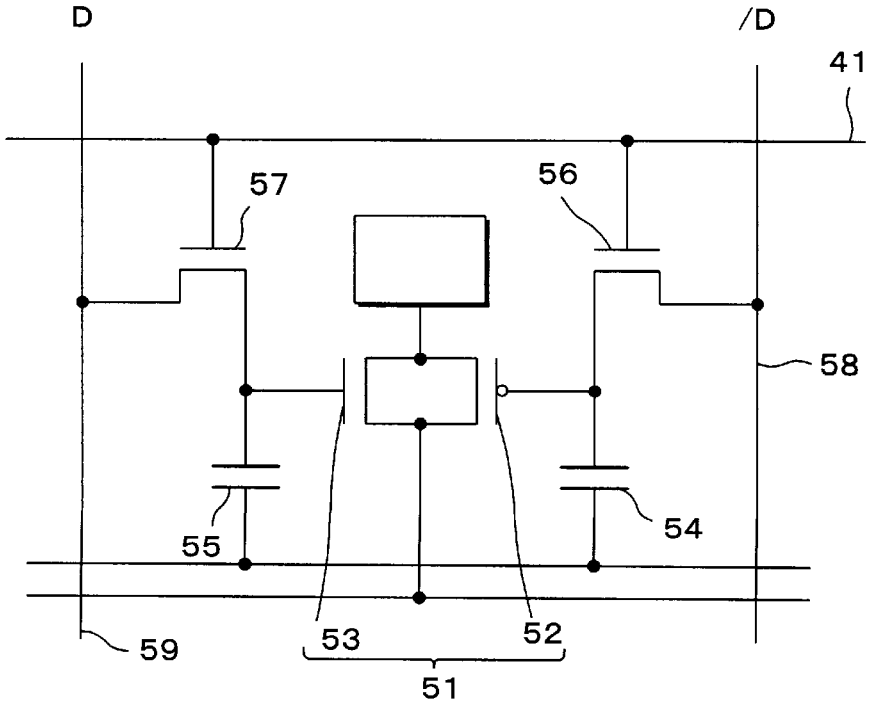
FIG. 23 is a diagram showing another example of the circuit configuration of each pixel in the display device of FIG. 21.

Given the foregoing, a comparison will be made below between the present invention and an arrangement shown in FIG. 19, in which a plurality of memory cells m1 to mn are similarly used to attain multi-gray-level display. The present invention, on one hand, has an arrangement in which each of the colors R, G, B requires one signal line S, and the selection line G and bit selection lines B1, B2 to be shared among the colors R, G, B; when the number of bits is x ($x \geqq 2$ in particular), 1 line×3(R, G, B)+1 line+x lines=4 lines+x lines. On the other hand, in the arrangement of FIG. 19, x lines×3(R, G, B)+1 line (a row electrode control signal line)=3x lines+1 line; the number of wires can largely be reduced accordingly. Therefore, even when a wired area in each pixel area A is reduced while increasing the number of gray-levels, an area to produce the memory elements M1, M2 and the like can sufficiently be secured.

Further, data is fed from the CPU 64 to the SRAM 66 provided outside the display area, and a writing rate of data from the CPU 64 and a writing rate of data to the memory elements M1, M2 are adjusted, then, a plurality of data from the SRAM 66 are written directly into the memory elements M1, M2 so as to be in parallel. Accordingly, it is no longer required that data from the SRAM 66 be serially converted and transferred, unlike a conventional signal line driving circuit. Further, since gray-scale display using digital data is realized for each pixel, a power-consuming D/A converter is not required between the SRAM 66 and the pixels, thus attaining low power consumption.

Particularly, in the case of a mobile phone or the like which often displays a still-frame image, power consumption in D/A conversion of data is larger than that in data transfer. Therefore, more power is required in generating an analog voltage from grayscale data than in serially transmitting the gray-scale data. Accordingly, such effect that sufficiently compensates for the foregoing defects is expected.

Furthermore, the memory elements M1, M2 are made up of two-stage CMOS inverters INV1, INV2 as with an ordinary SRAM. Therefore, p-type TFTs P1, P2 and n-type TFTs N1, N2, which respectively belong to the inverters INV1, INV2, are selectively turned ON. Accordingly, only the small amount of current passes through the respective inverters INV1, INV2 while a memory condition is maintained, thereby attaining low power consumption.

Note that, in the foregoing arrangement, the signal line S is shared by a plurality of bits. Therefore, compared to a case shown in FIG. 9 in which secured are signal lines S as many as memory elements, there is such a drawback that a data transfer frequency becomes a direct multiple of the number of bits. However, when m×n shows the number of pixels in a display device, after data is serially transferred from the SRAM 66 to a conventional signal line driving circuit, the required transfer frequency becomes n multiples of the number of parallels of the signal line S. Generally, n is not less than 80. On the other hand, the number x of bits is 8 or so. Therefore, even with the foregoing arrangement, there remains an adverse effect of decreasing a transfer rate of data to the memory elements M1, M2 due to parallel transfer of data.

Meanwhile, the following will explain display of the plurality of images. For example, when k is the number of memory elements M, and in the case of displaying a still-frame image, by reading data out of the memory element M after conversion, k pieces of images can be converted and displayed, in so far as the images are those of 1-bit gray-scale (2 gray-levels). More specifically, display can be performed in such a manner that k pieces of images are displayed in the case of 2-gray-level display, k/2 pieces of images are displayed in the case of 4-gray-level display, and the like. Further, each image should not necessarily have the same number of gray-levels, and for example, it is possible to switch between an image of j (j<k) bit gray-scale and an image of the other k−j bit grayscale. In this manner, a simple moving image can be displayed with power consumption which is substantially equal to that in displaying a still-frame image.

Further, when displaying the still-frame image, and in the case where, for example, 6-bit gray-scale display is desired, but memory elements for only 4 bits can be provided in a pixel, it can be arranged that the other 2-bit data is read out of the SRAM 66 outside the pixel as discussed. In that case, it is preferable that the SRAM 66 outside the pixel stores the 2-bit equivalent of data (more preferably, the 3-bit equivalent of data) with the SRAM configuration (the remainder may have the DRAM configuration).

Further, when a plurality of images are displayed, the larger number of memory elements are required. Here, as with the foregoing, it is only required that display be performed by reading necessary bit data out of a RAM outside the pixel to the memory element inside the pixel. Furthermore, it is also possible that, of all the necessary data for displaying a plurality of images, only the data required to display some of the images is stored in the memory elements in advance, then, when displaying the other images, new data is inputted from the RAM outside the pixel (at the same time, the data stored in the memory element is returned to the RAM outside the pixel), thereby displaying the plurality of images or a simple moving image without turning ON the power of the CPU.

Second Embodiment

Figure 5:
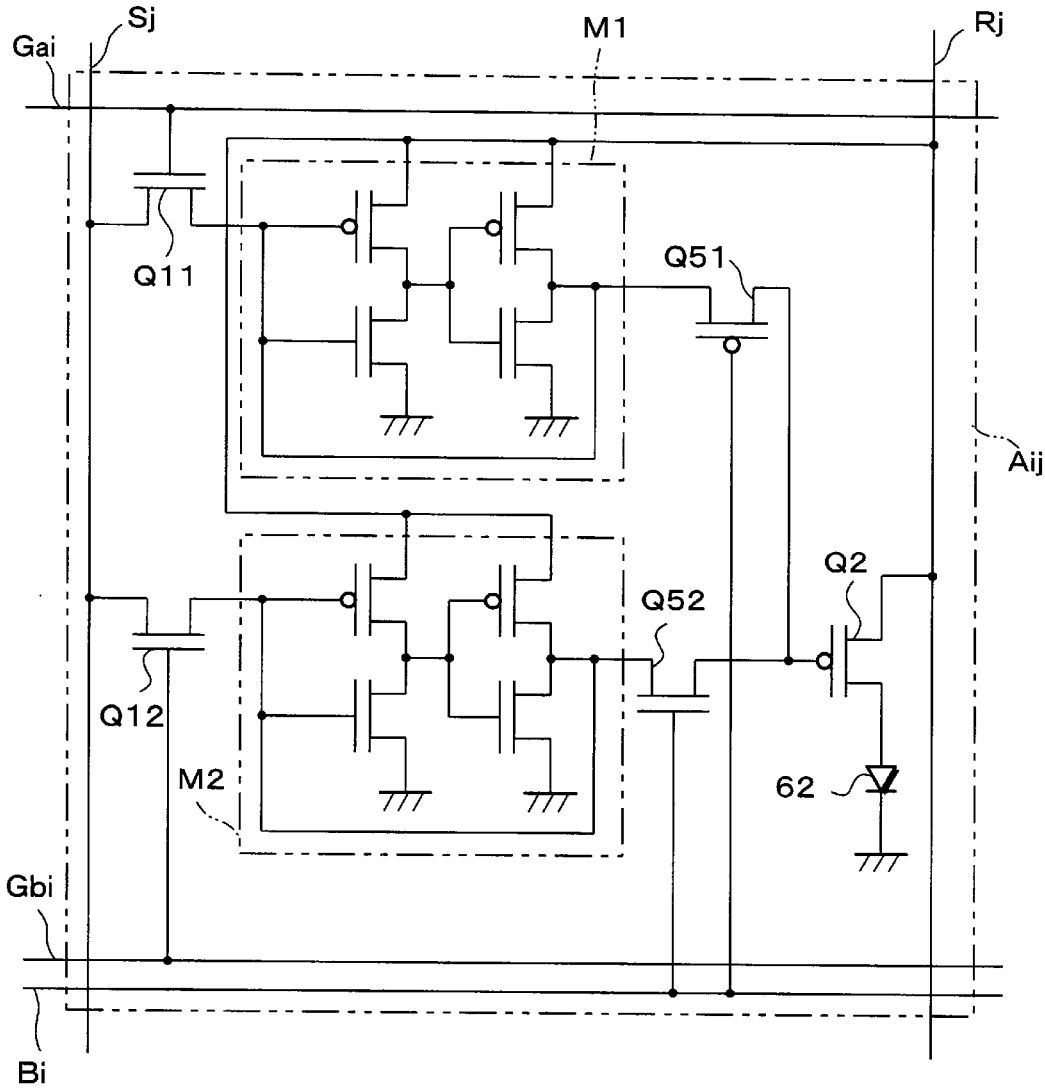
FIG. 5 is a diagram showing an electrical circuit of a pixel area in a display device according to a Second Embodiment of the present invention.
Figure 6:
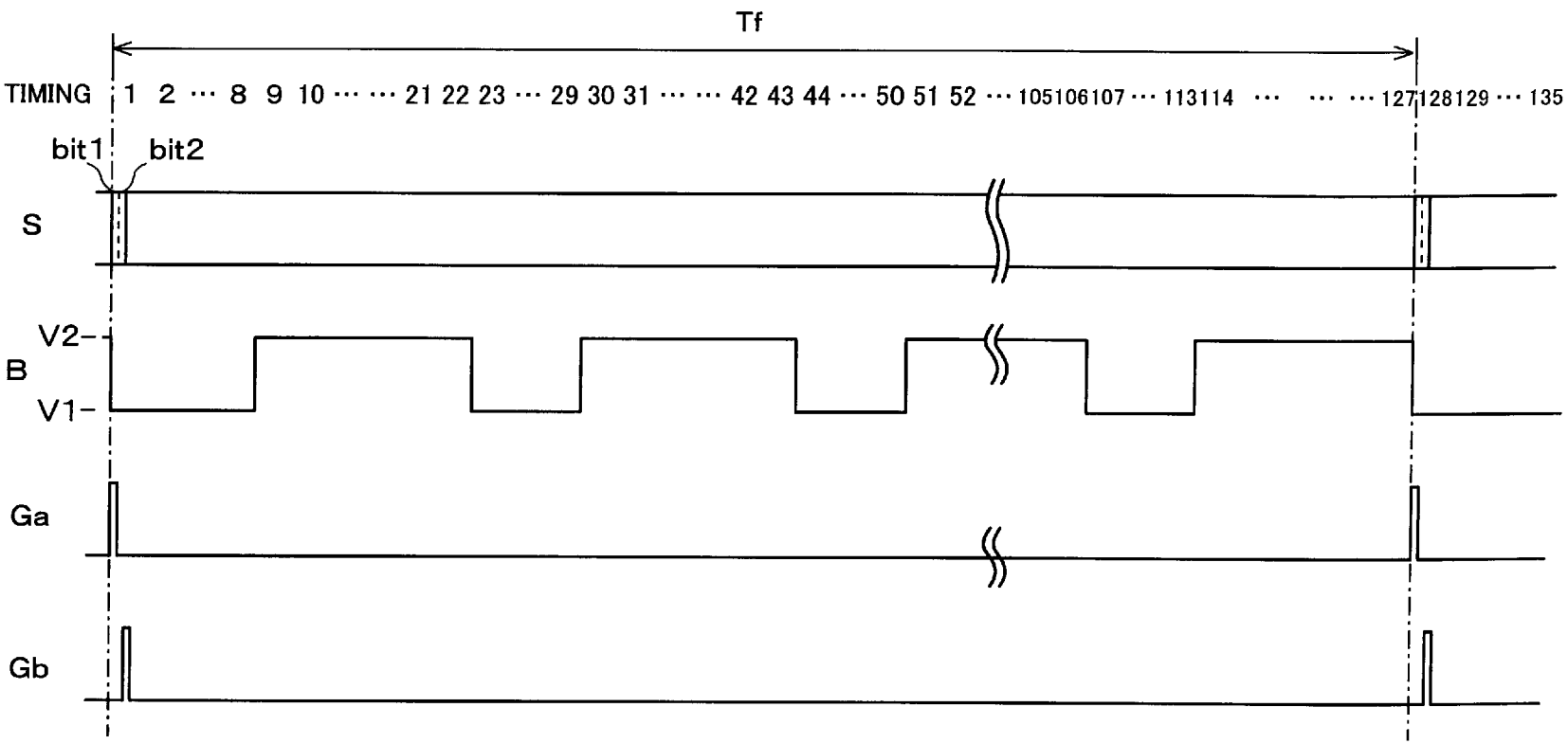
FIG. 6 is a diagram showing waveforms of signals applied to a bit selection line, a selection line and a signal line in the case of the display device of FIG. 5.

The following will describe the Second Embodiment of the present invention with reference to FIGS. 5 and 6.

FIG. 5 shows an electrical circuit of one pixel area A of a display device according to the Second Embodiment of the present invention. FIG. 5 is similar in arrangement to FIG. 3, and corresponding elements are given the same reference numerals and explanations thereof are omitted here. As in FIG. 3, for simplicity, FIG. 5 shows only two memory elements M1 and M2 which are provided as the memory element M. However, three or more memory elements may be accommodated as well.

What is significant in the arrangement of FIG. 5 is the provision of a TFT Q11 and a TFT Q12 for the memory elements M1 and M2, respectively, to make up the first active element (active element A) for receiving data from the same signal line S, and a TFT Q51 and a TFT Q52 which make up the third active element (active element C) for sending the output of the memory element M1 or M2 to a TFT Q2 of the electro-optical element. Application of a selection voltage to a selection line Ga activates the TFT Q11 to apply data from the signal line S to the memory element M1, and application of a selection voltage to a selection line Gb activates the TFT Q12 to apply data from the signal line S to the memory element M2.

The bit selection line, as indicated by reference numeral B, is shared by the two memory elements M1 and M2. Therefore, in order to selectively apply the output of the memory element M1 or M2 to the TFT Q2, the TFT Q51 of the memory element M1 and the TFT Q52 of the memory element M2 are p-type and n-type, respectively. Thus, application of a selection voltage from the bit selection line B to the gate of the TFT Q51 and TFT Q52 causes only one of the memory elements M1 and M2 to output a signal to the TFT Q2, thereby causing a current flow through an organic EL element 62 for only a corresponding time period.

FIG. 6 shows waveforms of signals to the bit selection line B, selection lines Ga and Gb, and signal line S. As in the foregoing example, one frame period Tf is also divided into 127 periods in FIG. 6. At timing 1 for feeding data, the selection lines Ga and Gb become High level (selection voltage) one after another according to the bit data from the signal line S, so as to apply data from an SRAM 66 to the memory elements M1 and M2. At the other timings 2 through 127 for displaying data, the selection lines Ga and Gb become Low level (non-selection voltage), and the voltage of the bit selection line B is switched between a selection voltage V1 of the memory element M1 and a selection voltage V2 of the memory element M2 according to the weight proportion of the bit, so as to selectively output data of the memory elements M1 and M2 to the TFT Q2.

Multi-gray-level display is thus carried out by the 1:2 ratio of selection voltages V1 and V2 sent to the bit selection line B. Further, different binary data (character or image) may be stored in the memory elements M1 and M2. In this case, the periodic image of the two binary data, i.e., a simple recurrent moving image can be displayed by periodically switching the voltage V1 and voltage V2 of the bit selection line B over the period of one or more frames. Such a function can be suitably employed to create a standby screen of a portable phone, etc.

Third Embodiment

Figure 7:
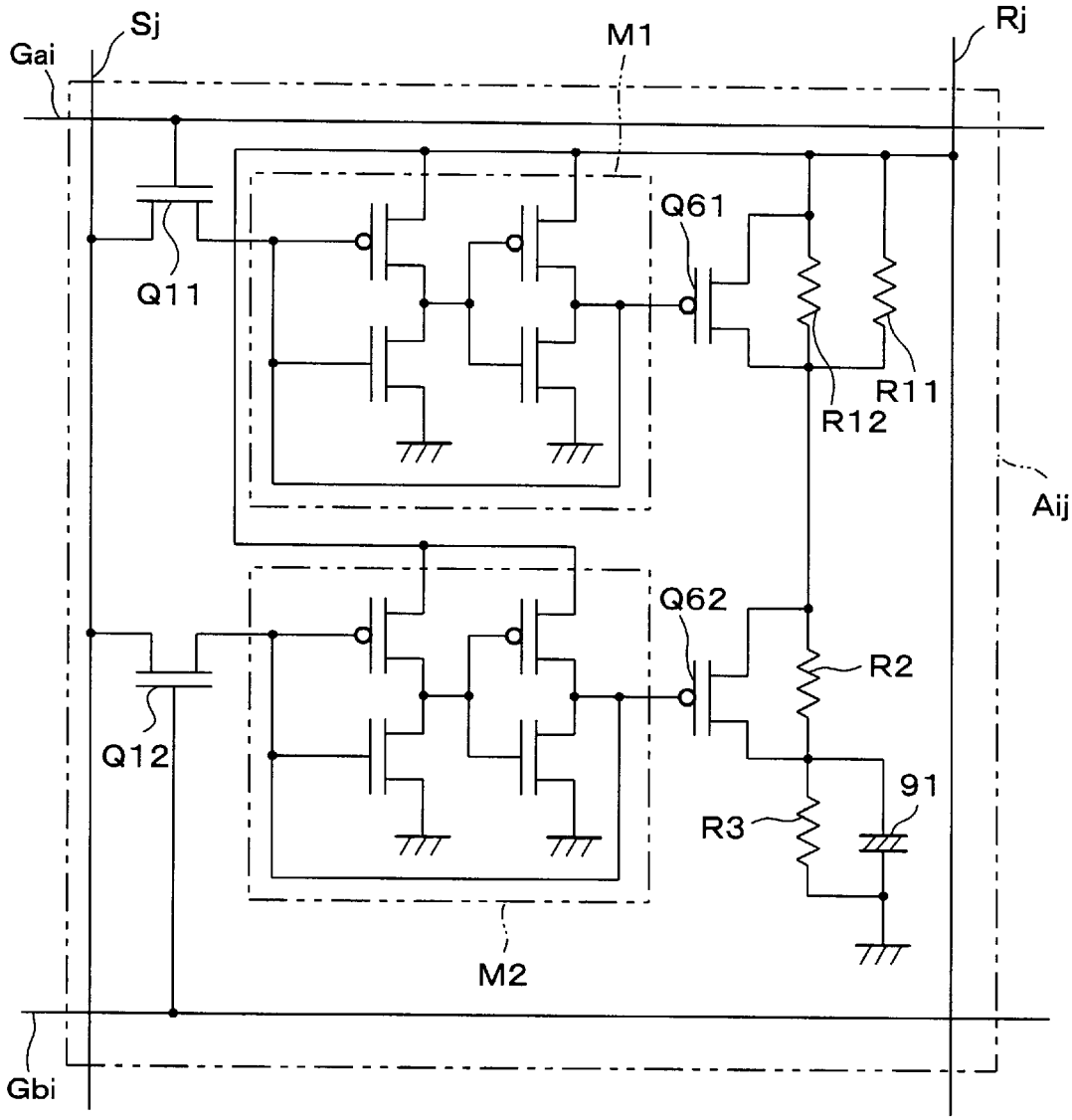
FIG. 7 is a diagram showing an electrical circuit of a pixel area in a display device according to a Third Embodiment of the present invention.
Figure 8:
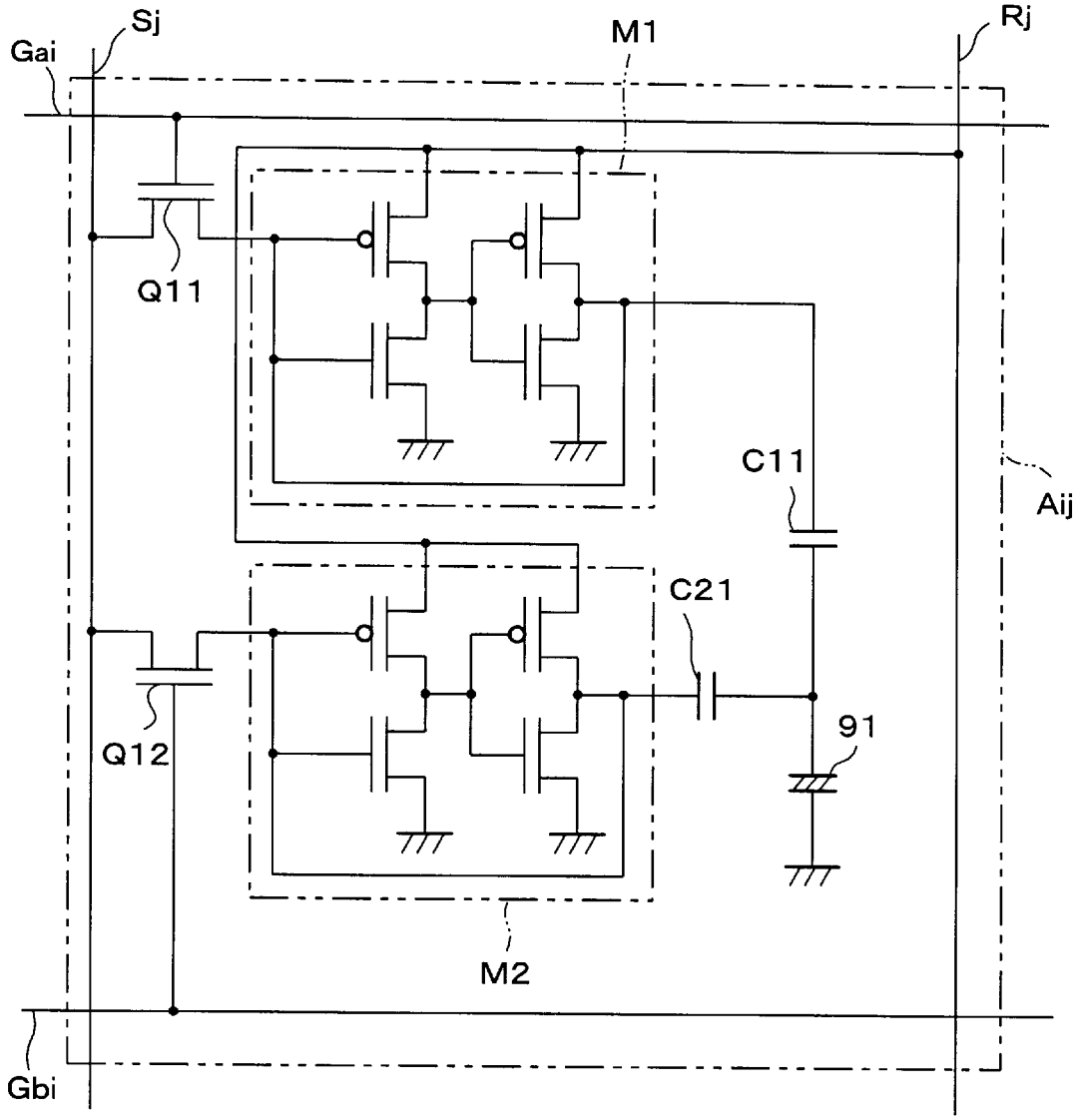
FIG. 8 is a diagram showing an electrical circuit configuration of a D/A converter which can attain low power consumption in the display device according to the Third Embodiment of the present invention.

The following will describe the Third Embodiment of the present invention with reference to FIG. 7 and FIG. 8.

FIG. 7 shows an electrical circuit of one pixel area A of a display device according to the present embodiment. FIG. 7 is similar in arrangement to FIG. 5, and corresponding elements are given the same reference numerals and explanations thereof are omitted here. As in FIG. 3, for simplicity, FIG. 7 shows only two memory elements M1 and M2 which are provided as the memory element M. However, three or more memory elements may be accommodated as well.

In the arrangements of FIGS. 1 through 5, time-sequential toning is adopted to realize gray-scale display. However, the mode of realizing gray-scale display is not limited in the present invention, and other electro-optical elements can also be used for the organic EL element 62. As such an example, the present embodiment describes the case where a liquid crystal 91 is used as the electro-optical element, and gray-scale display is realized by applying an analog voltage to the liquid crystal 91.

The liquid crystal 91 is disposed between a reference line (power line) R of power voltage VDD and GND by the serial connection with a parallel circuit composed of resistors R11 and R12 and with a resistor R2. The bit selection line B (B1, B2) is not provided in this structure, and the output of the memory elements M1 and M2 is sent to their respective p-type TFTs Q61 and Q62 which are controlled to switch ON or switch OFF. The TFT Q61 is provided parallel to the resistors R11 and R12, and the TFT Q62 is provided parallel to the resistor R2. The liquid crystal 91 is parallel to a resistor R3.

The reason the resistors Rll and R12 are provided in parallel is to prepare a resistance of a ½ resistance value. This is in consideration of the fact that, by the influence of various processes such as etching conditions, it is relatively easy to prepare resistances of essentially equal values, whereas it is difficult to prepare a resistance of a ½ resistance value by itself. It is therefore preferable that the resistance values of the resistors Rll, R12, R2, and R3 are equal to one another.

Ignoring the ON resistance of the TFTs Q61 and Q62, the liquid crystal 91 receives the voltage $$VDD\times(R3/((R11//R12)+R2+R3))$$

when the TFTs Q61 and Q62 are both OFF, and the liquid crystal 91 receives the voltage $$VDD\times(R3/(R2+R3))$$

when the TFT Q61 is ON and the TFT Q62 is OFF, and the liquid crystal 91 receives the voltage $$VDD\times(R3/((R11//\S R12)+R3))$$

when the TFT Q61 is OFF and the TFT Q62 is ON. The liquid crystal 91 directly receives the voltage VDD when the TFTs Q61 and Q62 are both ON. Note that, in the foregoing expressions, (R11//R12) indicates a parallel resistance value of R11 and R12, which can be expressed as (R11×R12)/(R11+R12).

Thus, under the condition where the resistors R1, R12, R2, R3 all have the same value, the voltage 2VDD/5 is applied when the TFTs Q61 and Q62 are both OFF, and the voltage VDD/2 is applied when the TFT Q61 is ON and the TFT Q62 is OFF, and the voltage 2VDD/3 is applied when the TFT Q61 is OFF and the TFT Q62 is ON. In this manner, a simple D/A converter can also be created in the pixel area A.

When the electro-optical element is the liquid crystal 91, it is particularly effective to switch ON/OFF of the TFTs Q61 and Q62 of the memory elements M1 and M2 in the described manner to divide the power voltage VDD which is supplied from the reference line (power line) R and to apply it to the electro-optical element after voltage conversion. Further, instead of the resistors R11, R12, R2, and R3, capacitors may be used to divide the voltage.

Note that, the arrangement of FIG. 7 does not allow switching of plural images for display. However, images can be switched by providing the third active element (active element C) between the memory elements M1 and M2 and the TFTs Q61 and Q62, and by using this third active element in combination with the memory elements M1 and M2. Further, the control timings in this arrangement are the same as those described with reference to FIG. 6, except for the bit selection line B, which is not provided in this arrangement. Thus, further explanations are omitted here.

The arrangement of FIG. 7 is effective in terms of the reduced number of wires in the display area A, but it is not so effective when it comes to reducing power consumption. FIG. 8 shows an example of a more preferable arrangement of the D/A converter which can reduce power consumption as well. In the arrangement of FIG. 8, the corresponding elements in the arrangement of FIG. 7 are indicated by the same reference numerals. The significance of this arrangement is that the output of the memory elements M1 and M2 is sent to the liquid crystal 91 via capacitors C11 and C12. That is, no resistance is used in this arrangement and therefore less power is consumed, which contributes to lower power consumption.

In this arrangement, when the electrostatic capacity of the liquid crystal 91 is CLC, and the electrostatic capacities of the capacitors C11 and C21 are C11 and C21, respectively, a zero voltage is applied to the liquid crystal 91 when the output of the memory elements M1 and M2 is at GND potential. The voltage $$VDD\times C11/(CLC+C11+C21)$$

is applied when the output of the memory element M1 is at VDD potential and when the output of the memory element M2 is at GND potential. The voltage $$VDD\times C21/(CLC+C11+C21)$$

is applied when the output of the memory element M1 is at GND potential and when the output of the memory element M2 is at VDD potential. The voltage $$VDD\times(C11+C21)/(CLC+C11+C21)$$

is applied when the output of the memory elements M1 and M2 is at VDD potential.

Thus, multi-gray-level display can be realized with the liquid crystal 91 by setting, for example, C21=2×C11, by increasing C11 as large as CLC, and by setting a proper value for the power voltage VDD.

Fourth Embodiment

Figure 9:
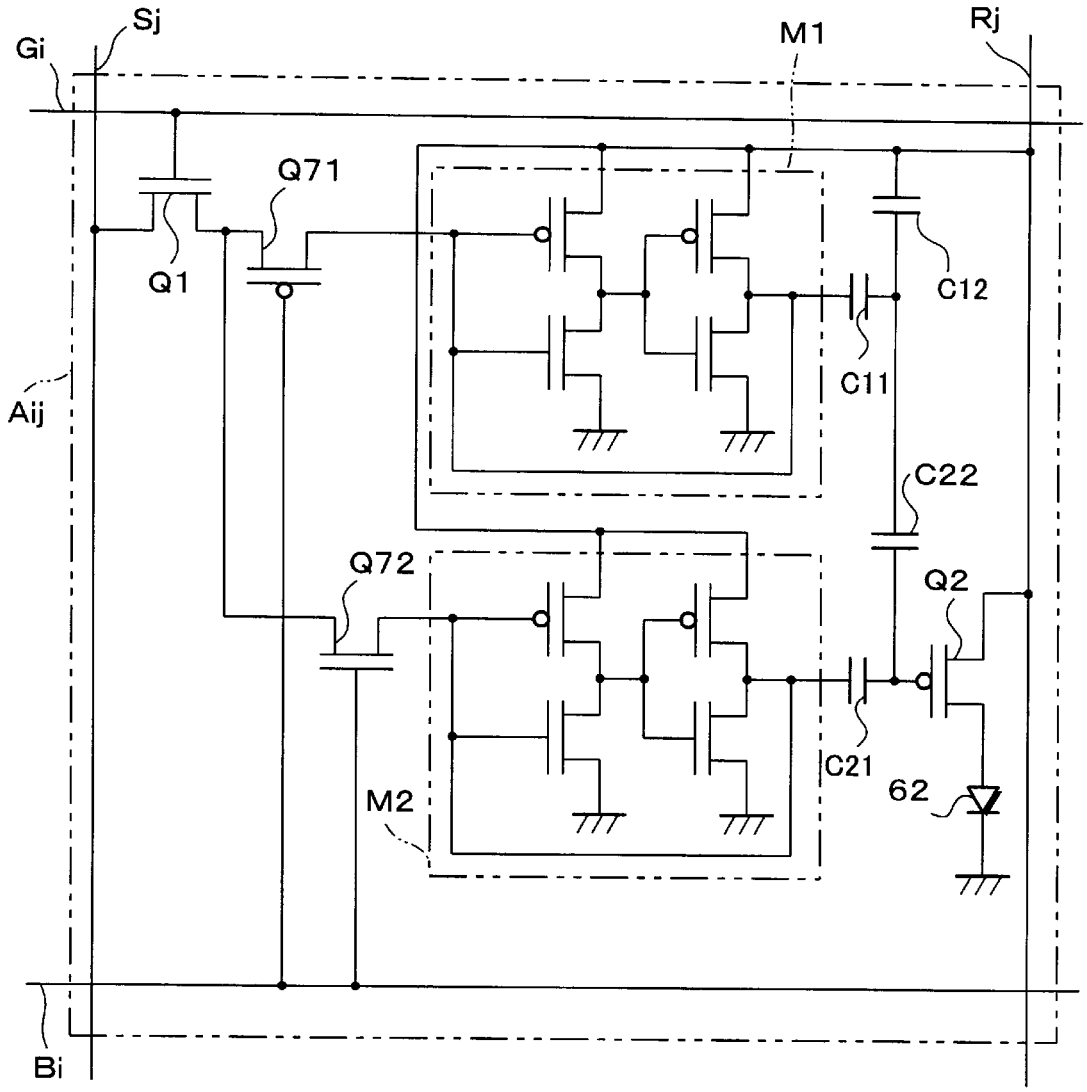
FIG. 9 is a diagram showing an electrical circuit of a pixel area in a display device according to a Fourth Embodiment of the present invention.
Figure 10:
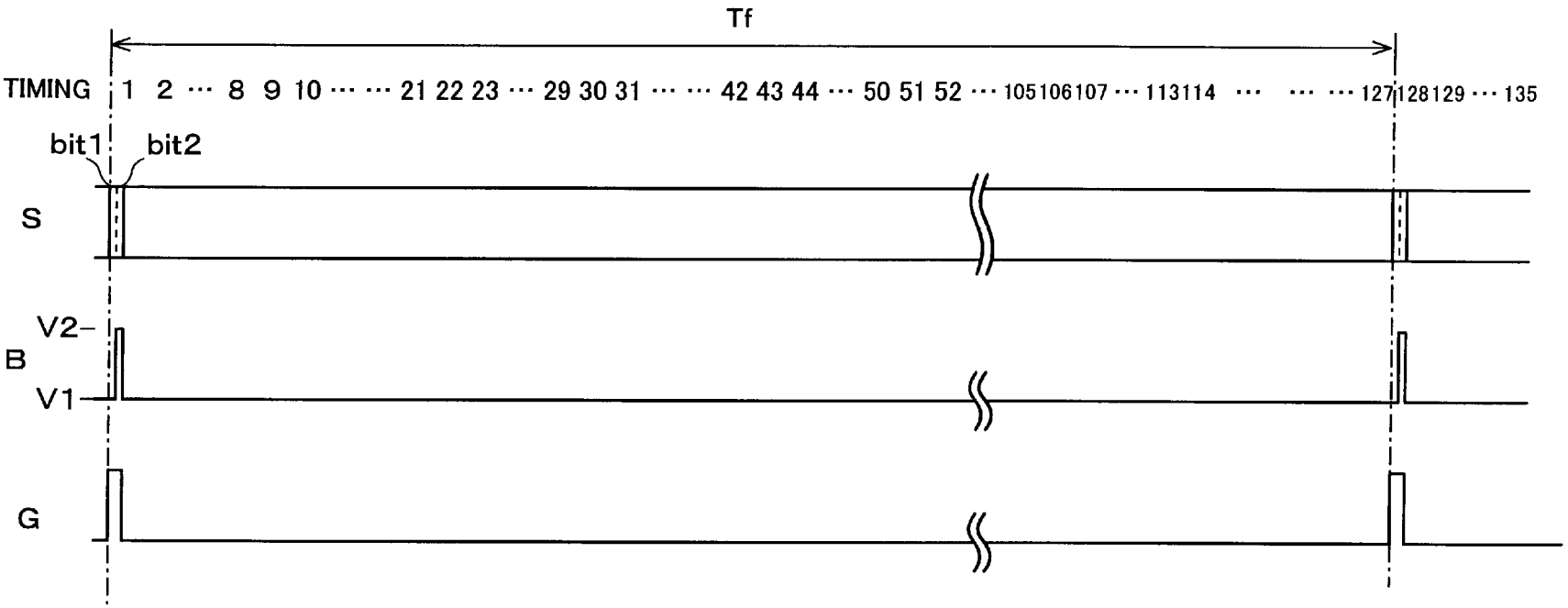
FIG. 10 is a diagram showing waveforms of signals applied to a bit selection line, a selection line and a signal line in the case of the display device of FIG. 9.
Figure 11:
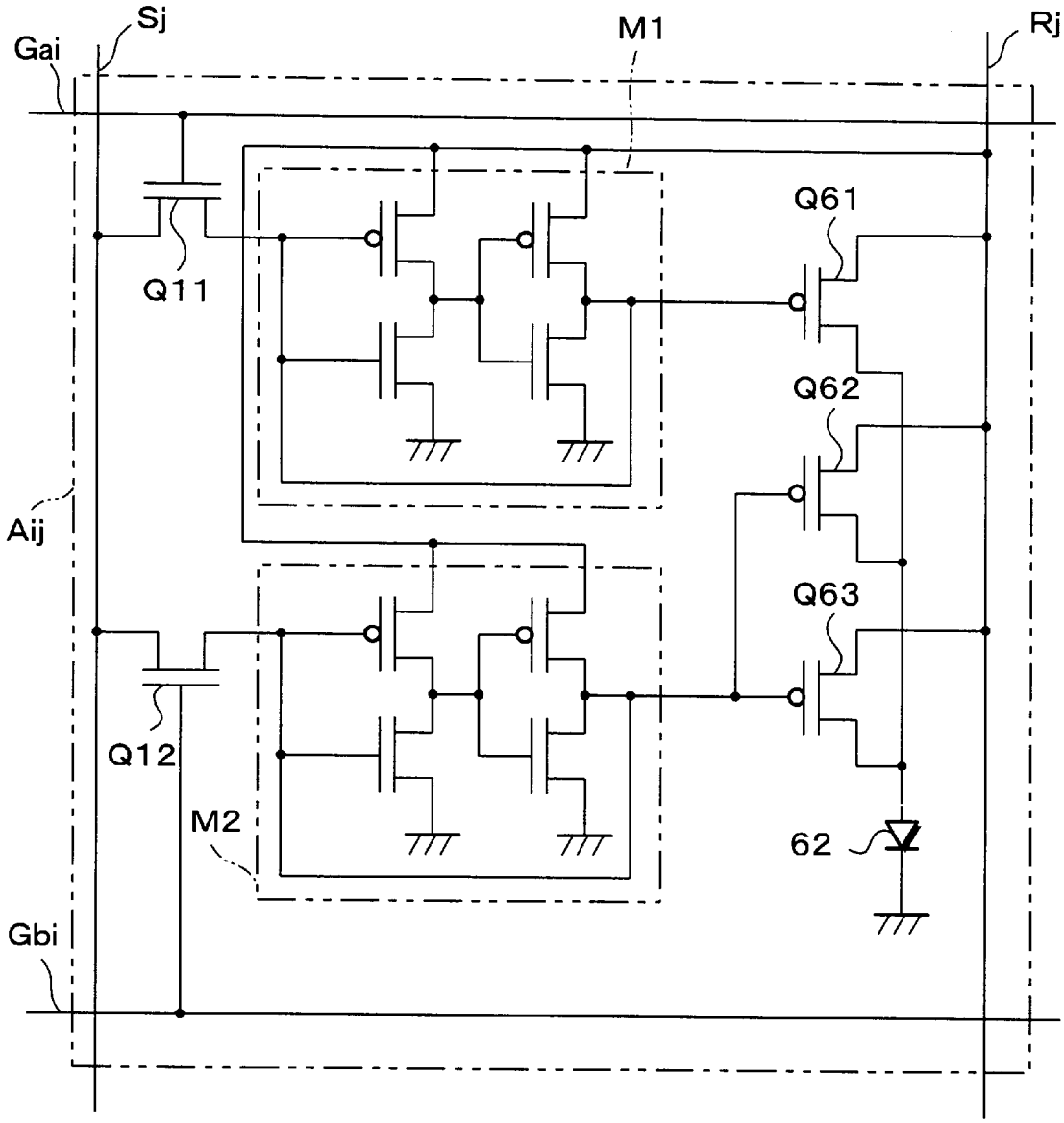
FIG. 11 is a diagram showing a most plain electrical circuit configuration in which an arrangement of FIG. 9 is adopted, and a value of current is set to be controlled without using time sequential toning with respect to a current-driven electro-optical element.

The following will describe the Fourth Embodiment of the present invention with reference to FIGS. 9 through 11.

FIG. 9 shows an electrical circuit of one pixel area A of a display device according to the present embodiment. FIG.

9 is similar in arrangement to FIG. 1, FIG. 5, and FIG. 8. In the arrangement shown in FIG. 9, a TFT Q2 generates a gate voltage for driving an organic EL element 62 by the D/A conversion function of the capacitors. To this end, one terminal of capacitors C21 and C22 is connected to the gate of the TFT Q2 which is on the output stage of a voltage. The other terminal of the capacitor 21 is connected to the output of a memory element M2, and the other terminal of the capacitor C22 is connected to one terminal of capacitors C11 and C12. The other terminal of the capacitor C11 is connected to the output of a memory element M1, and the other terminal of the capacitor C12 is connected to a reference line R of a power voltage VDD.

Here, the electrostatic capacity C21=C11=C12, and the electrostatic capacity C22=2×C21. That is, this is a so-called C-2C DAC configuration. The C-2C DAC configuration is described, for example, in a report in ASIA DISPLAY '98, p. 285 (held Sep. 28 to Oct. 1, 1998), and no further explanation will be given here to describe its principle. The capacitors may be arranged in this manner to provide the D/A convertor, so that the output of this D/A convertor is sent to the TFT Q2 to drive the organic EL element 62.

Further, in the arrangement of FIG. 9, a p-type TFT Q71 is provided as the second active element (active element B) between a TFT Q1, which is the first active element (active element A), and the memory element M1. Further, an n-type TFT Q72 is provided as the second active element (active element B) between a TFT Q1 and the memory element M2. To the gate of the TFTs Q71 and Q72 is supplied a selection voltage of the bit selection line B, so as to selectively apply data of the signal line S to the memory elements M1 and M2 via the TFT Q1.

FIG. 10 shows waveforms of applied signals to the bit selection line B, selection line G, and signal line S. As in the foregoing case, one frame period Tf is also divided into 127 periods in FIG. 10. At timing 1 for feeding data, the selection line G is switched one after another between selection voltage V1 of the memory element M1 and selection voltage V2 of the memory element M2 according to the bit data from the signal line S, so as to write data from an SRAM 66 into the memory elements M1 and M2. At other timings 2 through 127 for displaying data, the selection line G becomes Low level (non-selection voltage) to prohibit data application, and the bit selection line B is maintained at an arbitrary voltage (selection voltage V1 in FIG. 10).

This arrangement enables gray-scale display with the current-driven electro-optical element, without employing time-sequential toning, by the corresponding current which is obtained by controlling the gate voltage of the TFT Q2.

The output current from the memory elements M1 and M2 to the current-driven electro-optical element may be converted by controlling the gate voltage of the TFT Q2 in the foregoing manner to obtain the corresponding current. Other suitable methods for supplying a current to the electro-optical element include opening and closing of the switching elements of the memory elements M1 and M2 to change the proportion of the current supplied to the power wire and the electro-optical element. This method is particularly effective when the electro-optical element is the organic EL element. FIG. 11 shows an arrangement of such a case. In this arrangement, data from the signal line S is supplied to the memory elements M1 and M2 through their respective TFTs Q11 and Q12, and the output of the memory elements M1 and M2 is used to control TFTs Q61, Q62, and Q63. The TFTs Q61 through Q63 have the same size, and thus the same current flows through the TFTs Q61 through Q63 when they are ON.

This enables the memory element M2 to supply a current, twice the value of that of the memory element M1, to the organic EL element 62 according to the bit weight, thereby enabling gray-scale display with the electro-optical element, without employing time-sequential toning, only by writing data of the SRAM 66 into the memory elements M1 and M2.

Fifth Embodiment

Figure 12:
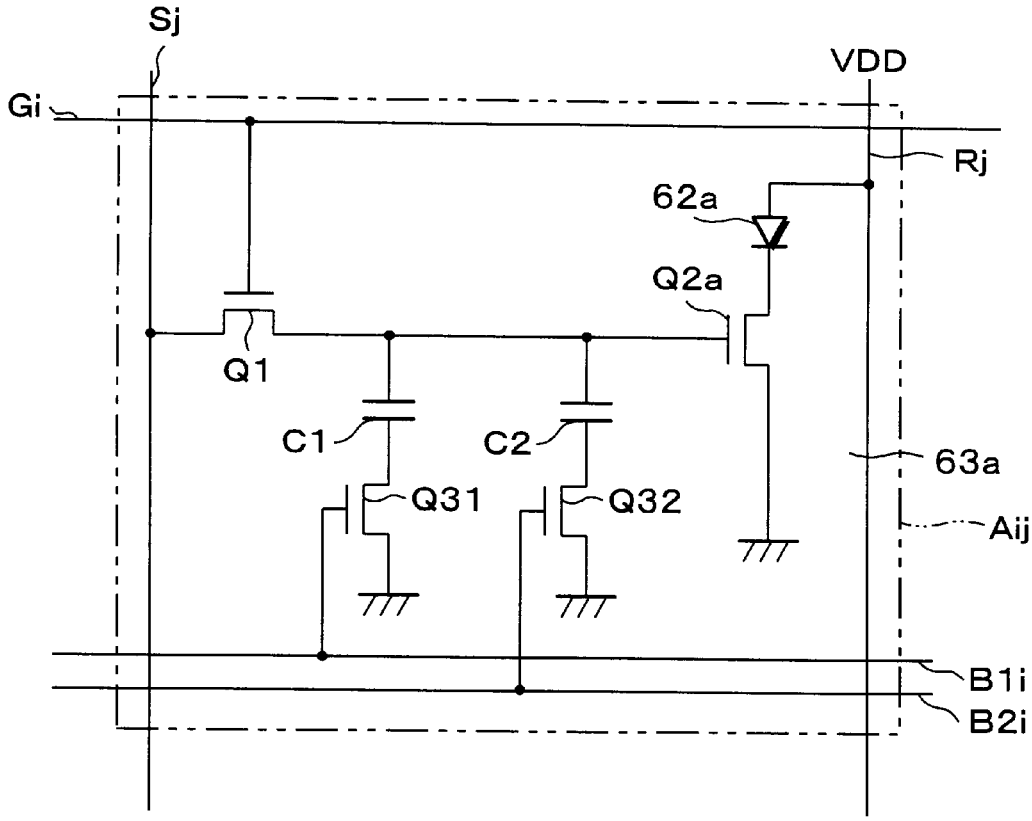
FIG. 12 is a diagram showing an electrical circuit of a pixel area in a display device according to a Fifth Embodiment of the present invention.

The following will describe the Fifth Embodiment of the present invention with reference to FIG. 12.

FIG. 12 shows an electrical circuit of one pixel area A of a display device according to the present embodiment. FIG. 12 is similar in arrangement to FIG. 3, and corresponding elements are given the same reference numerals and explanations thereof are omitted here. What is significant in this arrangement is that ferroelectric thin-film capacitors C1 and C2 are provided as the memory elements, which are connected in series to a TFT Q1 which is provided as the first active element (active element A), and TFTs Q31 and Q32 are provided as the second active element B between the memory elements and the GND. The ferroelectric thin-film capacitors C1 and C2 in FIG. 12 are used in a so-called 1T (transistor) 1C (capacitor) configuration as in an FRAM. This configuration requires a smaller circuit area than that in the SRAM circuit of FIG. 3 which uses four TFTs P1, P2, N1, and N2.

Note that, a process for fabricating the ferroelectric thin-film capacitor is taught, for example, in Japanese Unexamined Patent Publication No. 169297/2000 (Tokukai 2000-169297 published on Jun. 20, 2000), and no further explanation will be given here.

In the arrangement of FIG. 12, one terminal of the ferroelectric thin-film capacitors C1 and C2 is connected to the TFTs Q1 and Q2*a*, and the other terminal is grounded via the TFTs Q31 and Q32. In FIG. 1 and FIG. 3, the organic EL element 62 is composed of a substrate, anode, hole injection layer, hole transport layer, emission layer, electron transport layer, and cathode, which are stacked in this order on the substrate 63, wherein the organic EL element 62 is disposed between the p-type TFT Q2 and GND. On the other hand, in the arrangement of FIG. 12, an organic EL element 62*a* is composed of a substrate, cathode, electron transport layer, emission layer, hole transport layer, hole injection layer, and anode, which are stacked in this order on a substrate 63*a*, wherein the organic EL element 62*a* is inserted between an n-type TFT Q2*a* and power voltage VDD. This is to reduce the amplitude of the gate voltage of the TFTs Q2*a*, Q31, and Q32.

Sixth Embodiment

Figure 13:
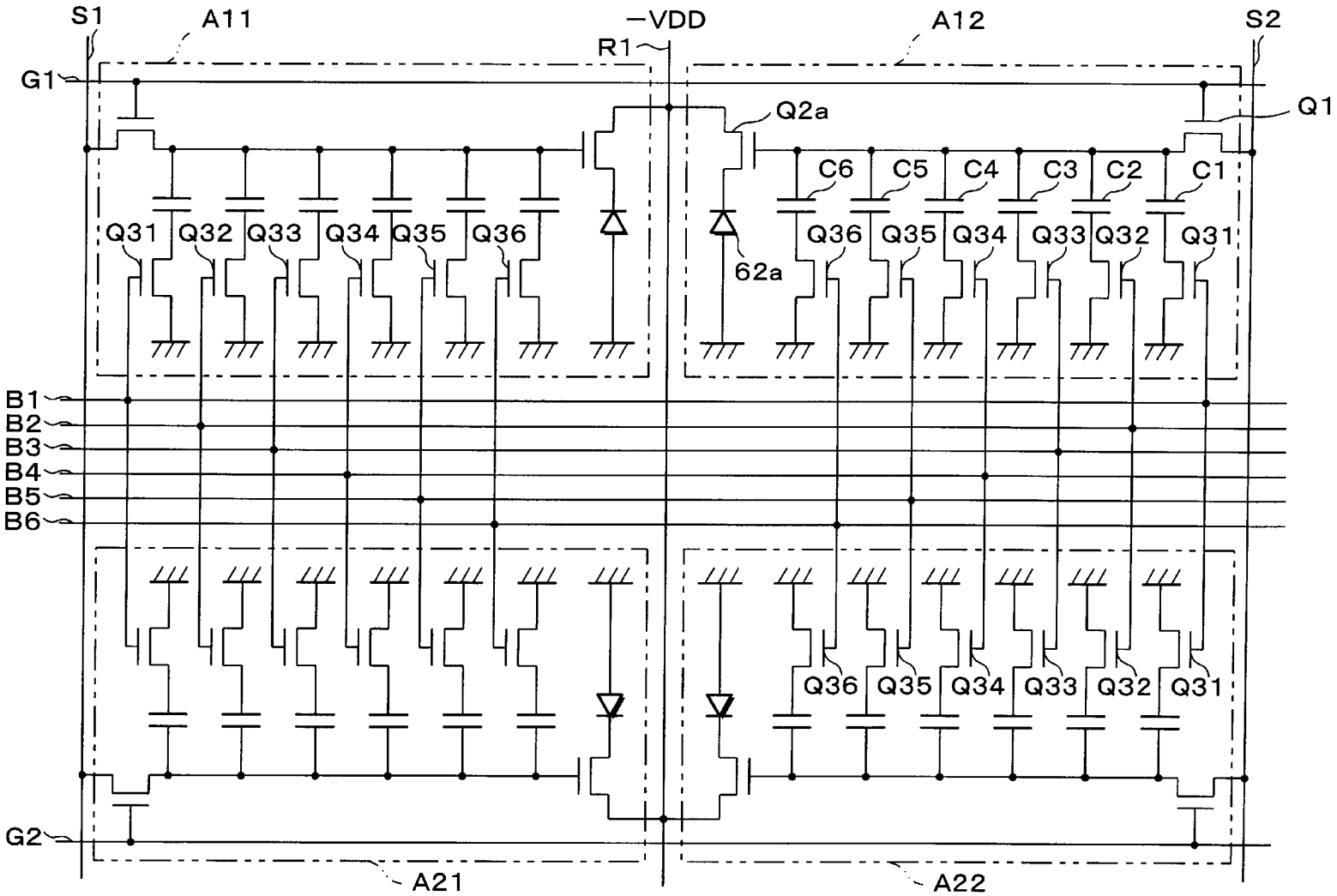
FIG. 13 is a diagram showing electrical circuits of four pixel areas in a display device according to a Sixth Embodiment of the present invention.
Figure 14:
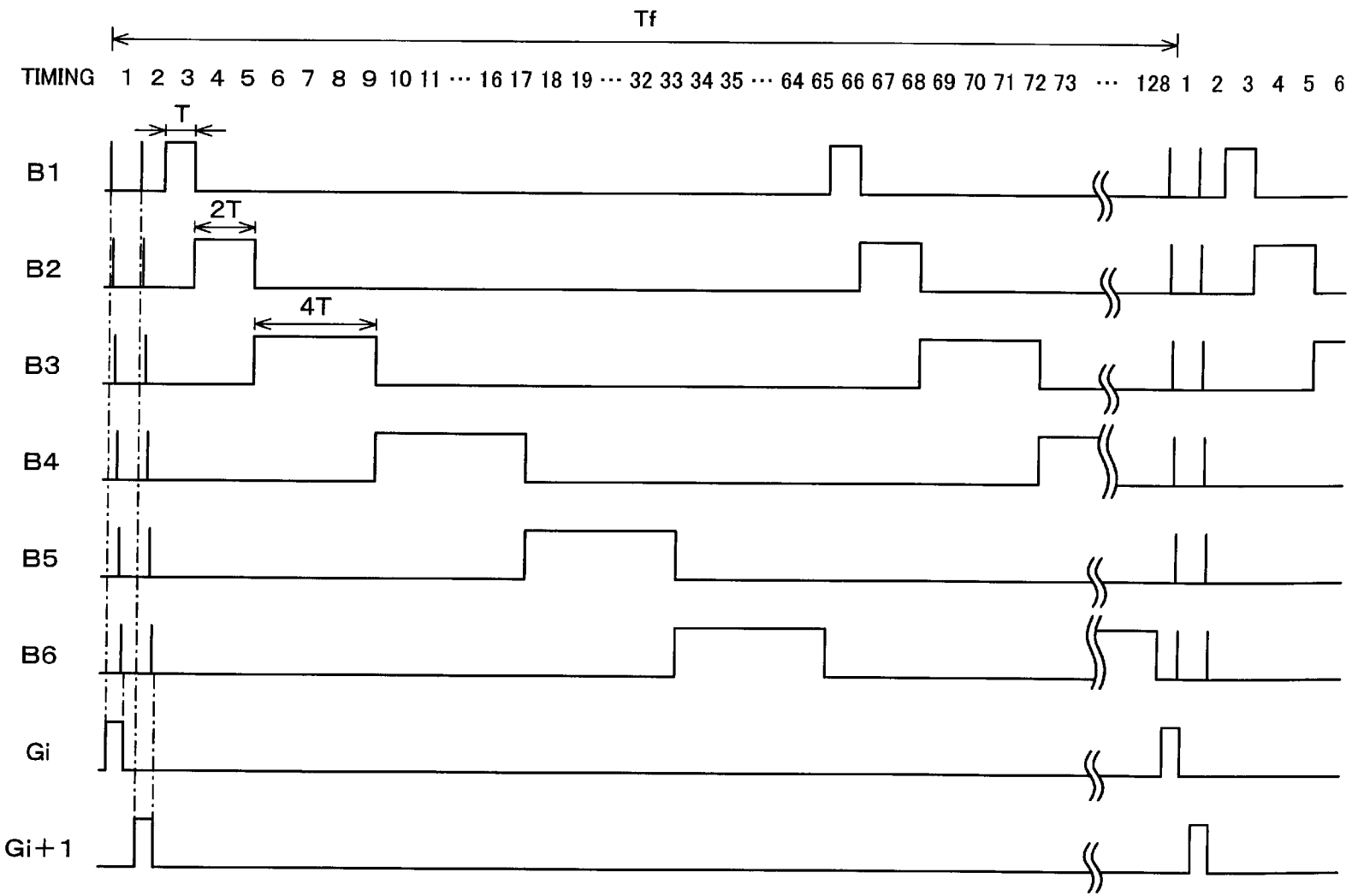
FIG. 14 is a diagram showing waveforms of signals applied to a bit selection line and a selection line in the display device of FIG. 13.

The following will describe the Sixth Embodiment of the present invention with reference to FIGS. 13 and 14.

FIG. 13 shows an electrical circuit of four pixel areas of a display device according to the present embodiment. FIG. 13 is similar in arrangement to FIG. 12, and corresponding elements are given the same reference numerals and explanations thereof are omitted here. What is significant in this arrangement is that each pixel has six ferroelectric thin-film capacitors C1 through C6 as the memory element. Further, bit selection lines B1 through B6 for driving respective TFTs Q31 through Q36 of the ferroelectric thin-film capacitors C1 through C6 are shared by pixels of odd numbered columns (A11 and A12 in FIG. 13) and pixels of even numbered columns (A21 and A22 in FIG. 13), i.e., by the pixels of adjacent lines, so as to reduce the proportion of the wired area in the display area. The voltage of a reference line R is −VDD, and the organic EL element 62*a* is used in conjunction with an n-type TFT Q2*a*.

FIG. 14 shows waveforms of applied signals to the bit selection lines B1 through B6, and selection lines Gi and Gi+1. In the example of FIG. 14, one frame period is divided into 128 periods. Briefly, at timing 1, the selection line Gi becomes High level, along with the bit selection lines B1 through B6 which selectively become High level, so as to apply data from an SRAM 66 to the ferroelectric thin-film capacitors C1 through C6 of the i-th row. At timing 2, the selection line Gi+1 becomes High level, along with the bit selection lines B1 through B6 which selectively become High level, so as to write data of an SRAM 66 into the ferroelectric thin-film capacitors C1 through C6 of the (i+1)-th row. At the other timings 3 through 128, the selection lines G and G+1 remain at Low level, and the bit selection lines B1 through B6 selectively become High level only for the duration of weighted bit, so as to output the data of the ferroelectric thin-film capacitors C1 through C6 to the TFT Q2*a*.

Note that, in this case, no data will be applied to the ferroelectric thin-film capacitors C1 through C6 of the (i+1)-th row while data is being applied to the ferroelectric thin-film capacitors C1 through C6 of the i-th row, because the selection line Gi+1 is at Low level when the selection line Gi is at High level.

More specifically, the bit selection lines B1, B2, B3, B4, B5, and B6 are selected according to the weighted bit only for the duration of unit period T, period 2T, period 4T, period 8T, period 16T, and period 32T, respectively. Further, in the example of FIG. 14, the unit period T is 1/128 of one frame period, and therefore each bit selection line B is selected only twice in one frame period $((128-2)/\{(1+2+4+8+16+32)\times 1\}=2)$.

Thus, at timings 1 and 2, data is supplied to the ferroelectric thin-film capacitors C1 through C6. At timing 3, the bit selection line B1 is selected. At timings 4 and 5, the bit selection line B2 is selected. At timings 6 through 9, the bit selection line B3 is selected. At timings 10 through 17, the bit selection line B4 is selected. At timings 18 through 33, the bit selection line B5 is selected. At timings 34 through 65, the bit selection line B6 is selected. Recurrently, at timing 66, the bit selection line B1 is selected again, and in the same manner, the bit selection line B6 is finally selected at timings 97 through 128.

In this way, the number of gray-levels can be increased.

Note that, in the example of FIG. 14, the same bit selection line is selected twice within one frame period. This is to prevent a pseudo contour in a moving image, which becomes a problem in PDP when emission is obtained only once in one frame period according to the bit. In this regard, in order to more effectively prevent a pseudo contour in a moving image by the multiple emissions as in FIG. 4, it is effective to create more selection periods within one frame period by dividing the selection period of those bits closer to the MSB (e.g., bit selection line B6 or B5).

Further, instead of providing the emission period over the entire frame period, it is more preferable to partially provide the emission period within one frame period, because in this case a pseudo contour and blur in a moving image can be effectively prevented. Such a non-emission state can be realized either by applying such a voltage to one of the six ferroelectric thin-film capacitors C1 through C6 of FIG. 13 that the organic EL element 62*a* does not emit light, and alternatively, by providing a wire carrying a voltage for preventing emission of the organic EL element 62 and by selecting this wire or a ferroelectric thin-film capacitor connected to this wire.

Seventh Embodiment

Figure 15:
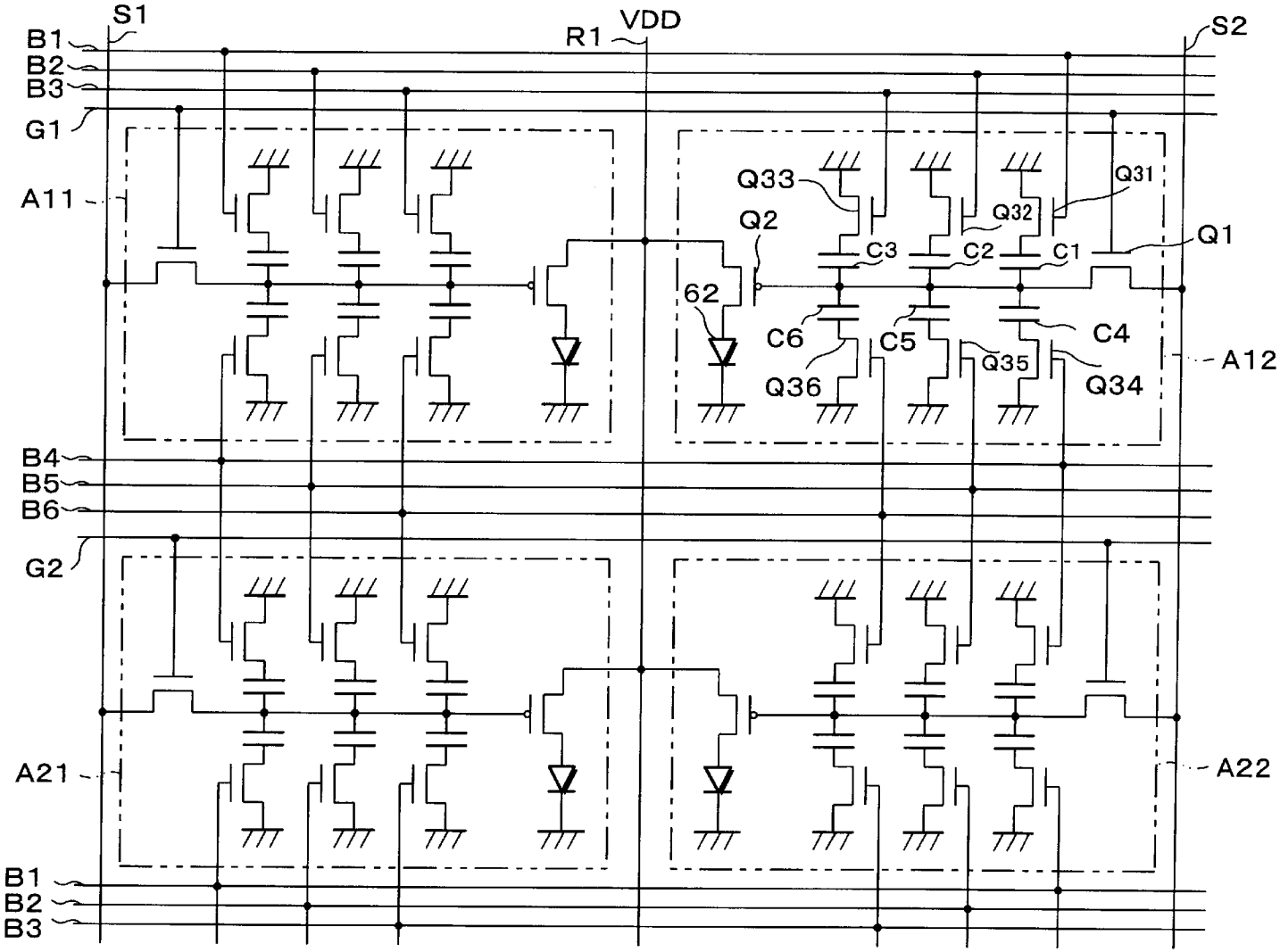
FIG. 15 is a diagram showing electrical circuits of four pixel areas in a display device according to a Seventh Embodiment of the present invention.

The following will describe the Seventh Embodiment of the present invention with reference to FIG. 15.

FIG. 15 shows an electrical circuit of four pixel areas of a display device according to the present embodiment. FIG. 15 is similar in arrangement to FIG. 13 and FIG. 3, and corresponding elements are given the same reference numerals and explanations thereof are omitted here. What is significant in this arrangement is that the bit selection lines B1 through B6 are divided into two groups, B1 through B3, and B4 through B6, which are disposed at equal row intervals. That is, while FIG. 15 is similar in arrangement to FIG. 13 in that the bit selection lines B1 through B6 are shared by the pixels of adjacent lines, it differs from FIG. 13 in that the bit selection lines B1 through B6, which are disposed altogether to be shared by the pixels of adjacent lines, are divided into two groups and separately provided in FIG. 15.

This is advantageous in terms of balancing the number of wires to improve uniformity of display.

Note that, in this case, the period of feeding data to the ferroelectric thin-film capacitors C1 through C6 as in the operation of FIG. 14 is increased from two unit time to three unit time. However, the rest of the operation remains the same and further explanations thereof are omitted here.

Eighth Embodiment

Figure 16:
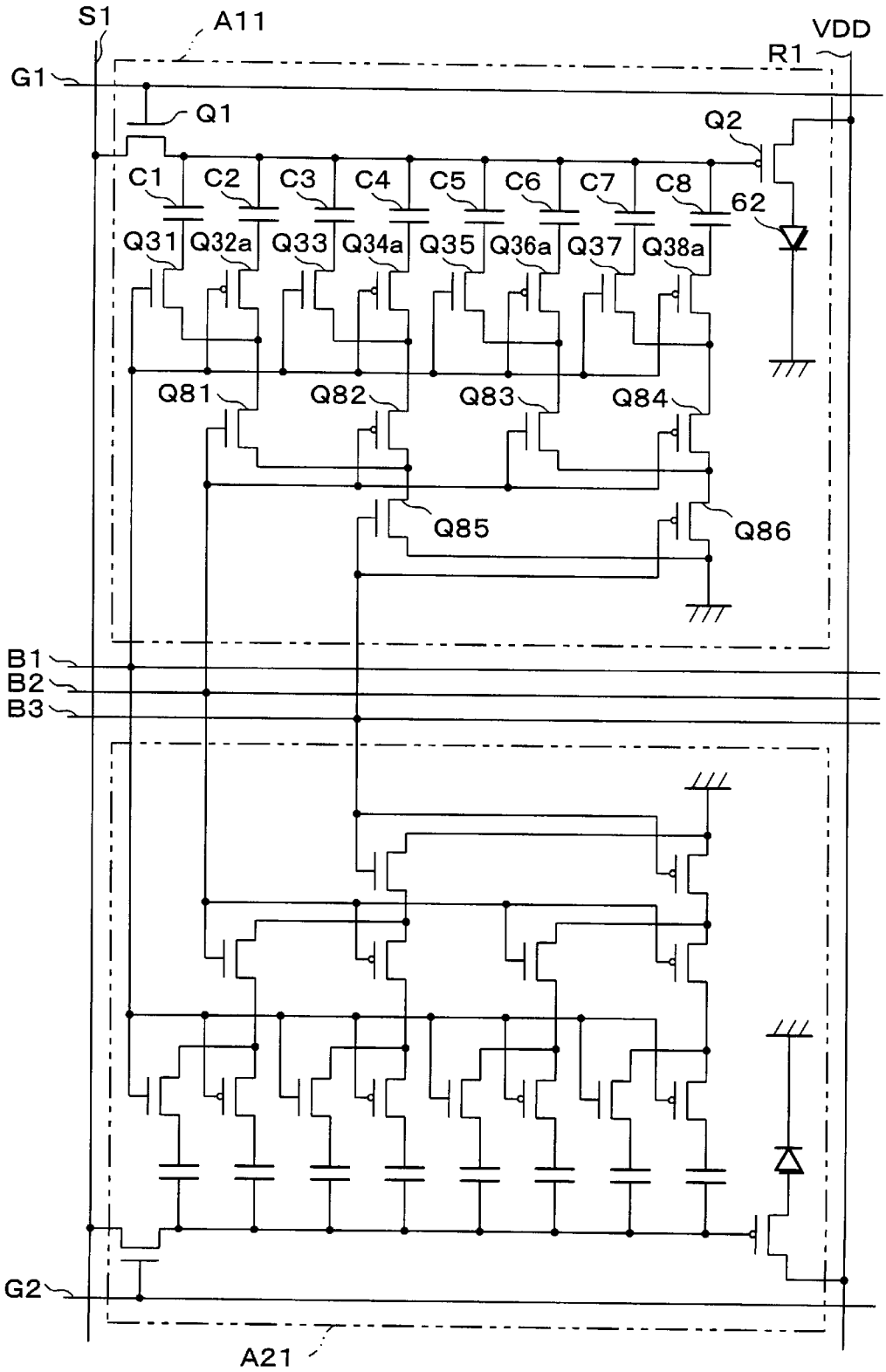
FIG. 16 is a diagram showing electrical circuits of two pixel areas in a display device according to an Eighth Embodiment of the present invention.
Figure 17:
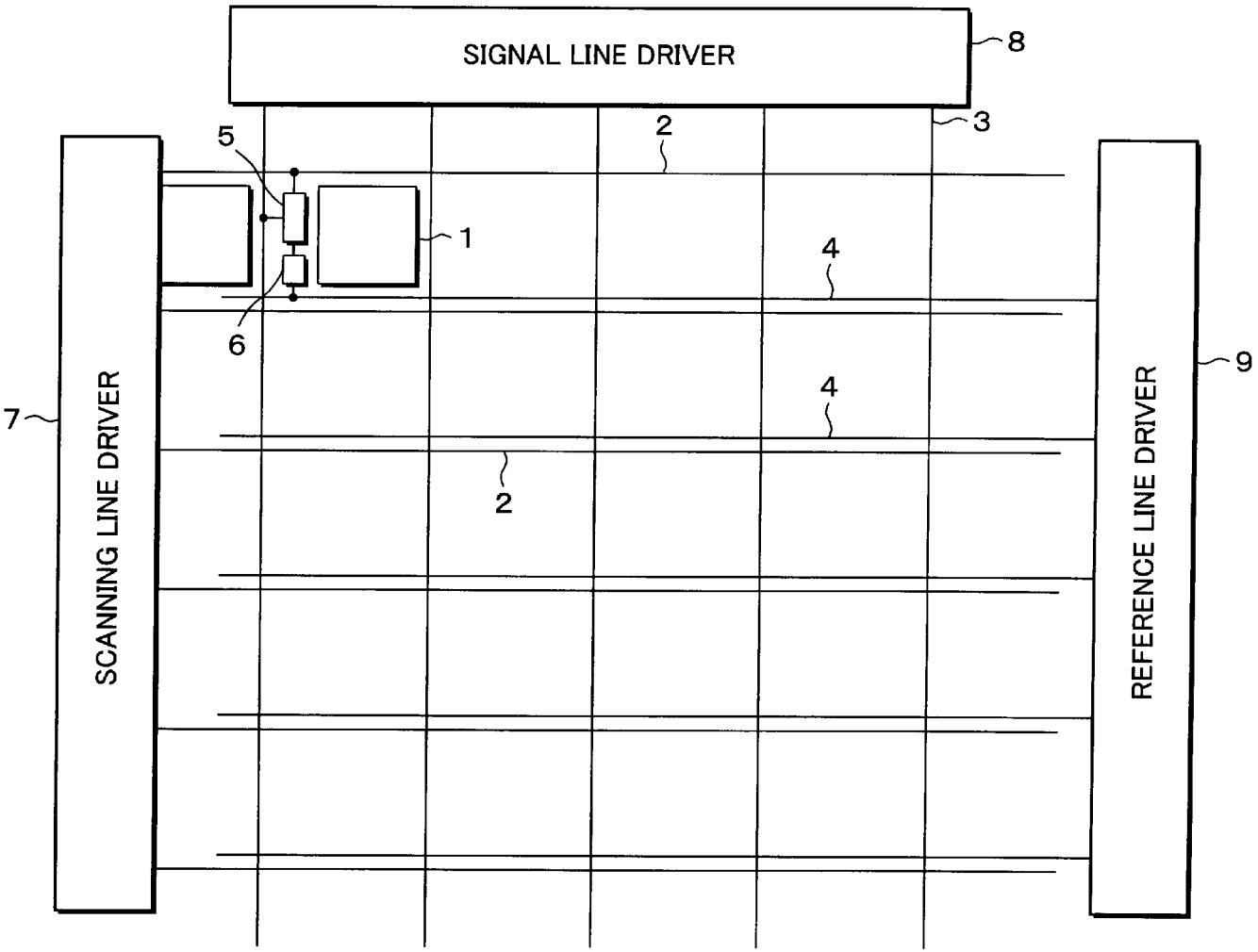
FIG. 17 is a block diagram schematically showing an arrangement of a display device according to typical prior art.
Figure 18:
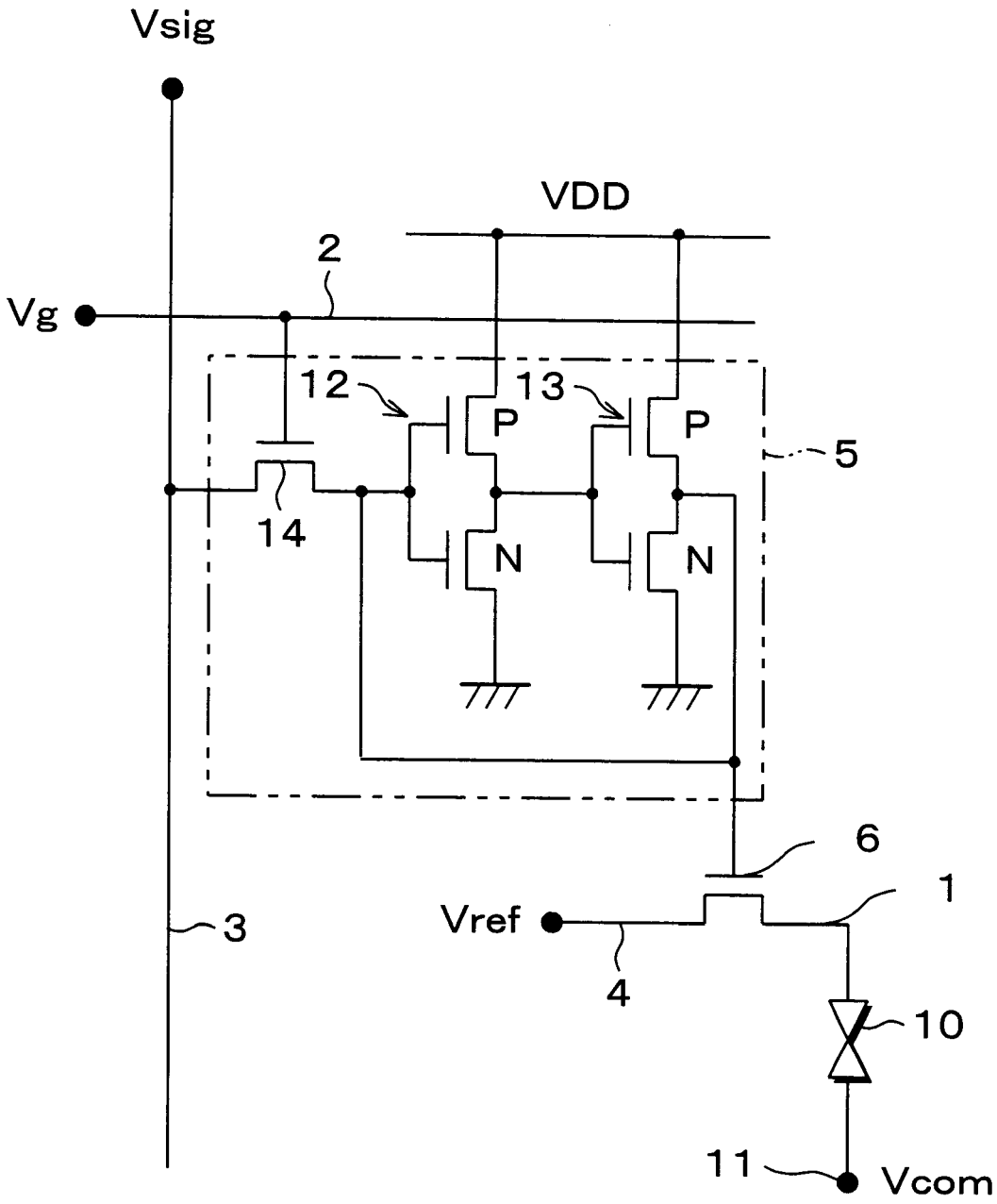
FIG. 18 is a diagram showing in detail a circuit configuration of each pixel portion in the display device of FIG. 17.

The following will describe the Eighth Embodiment of the present invention with reference to FIG. 16.

FIG. 16 shows an electrical circuit of two pixel areas of a display device according to the present embodiment. FIG. 16 is similar in arrangement to FIG. 14, and corresponding elements are given the same reference numerals and explanations thereof are omitted here. What is significant in this arrangement is that three bit selection lines B1 through B3 are used to decode the selected output in the pixels A11 and A21 and to select the corresponding capacitor from the ferroelectric thin-film capacitors C1 through C8. Thus, since $2^3=8$, there are provided eight ferroelectric thin-film capacitors C1 through C8. Further, n-type TFTs Q31, Q33, Q35, and Q37 are provided for the odd numbered ferroelectric thin-film capacitors C1, C3, C5, and C7, respectively, and p-type TFTs Q32*a*, Q34*a*, Q36*a*, and Q38*a* are provided for the even numbered ferroelectric thin-film capacitors C2, C4, C6, and C8, respectively. In addition, TFTs Q81 through Q86 (decode means) for decoding the selected signal are provided.

As a result, the proportion of the wired area can be further reduced.

As described in the First to Eighth Embodiments, an example of a display device according to the present invention, in the display device in which each of electro-optical elements is provided in each area arranged in a matrix, a memory element captures data from a signal line via a first active element (active element A) in between, the first active element being provided for each area, and output of the memory element activates the electro-optical element for display, has an arrangement such that two or more of the memory elements associated with the respective electro-optical elements are provided with respect to each of the signal lines, and the electro-optical elements are activated for display by output, in part or in full, of the respective memory elements.

Further, another example of a display device according to the present invention, in the display device in which a memory element captures data from a signal line via a first active element (active element A) in between during a selection period of the first active element selected by a selection line, and an electro-optical element performs display according to storage contents of the memory element, has an arrangement such that the number of the memory elements, which are provided in association with the respective electro-optical elements and with respect to each of the signal lines, is the same as the number of bits which are associated with at least a portion of desired gray-levels and/or images for display, and the display device further including second active elements (active elements B) provided in association with the respective memory elements, and bit selection lines which are routed so as to be shared by control input terminals of the second active elements having the equivalent bit order to each other, either one of the bit selection lines being selected at a time for each bit order, the bit selection lines causing data to be stored in the associated memory element via the first active element during a selection period of the selection line, and the data stored in the associated memory element to be outputted to the electro-optical element during a non-selection period of the selection line.

Still another example of a display device according to the present invention, in the display device in which a memory element captures data from a signal line via a first active element (active element A) in between during a selection period of the first active element selected by a selection line, and an electro-optical element performs display according to storage contents of the memory element, has an arrangement such that the number of the memory elements, which are provided in association with the respective electro-optical elements and with respect to each of the signal lines, is the same as the number of bits which are associated with at least a portion of desired gray-levels and/or images for display, and the selection lines and the first active elements are respectively provided in association with the memory elements, and the display device further comprising third active elements (active elements C) provided in association with the respective memory elements, and bit selection lines which are routed so as to be shared by control input terminals of the third active elements having the equivalent bit order to each other, either one of the bit selection lines being selected at a time for each bit order, the bit selection lines activating the third active elements to output the data stored in the associated memory element with respect to the electro-optical element.

Yet another example of a display device according to the present invention, in the display device in which a memory element captures data from a signal line via a first active element (active element A) in between during a selection period of the first active element selected by a selection line, and an electro-optical element performs display according to storage contents of the memory element, has an arrangement such that the number of the memory elements, which are provided in association with the respective electro-optical elements and with respect to each of the signal lines, is the same as the number of bits which are associated with at least a portion of desired gray-levels for display, the first active elements and the selection lines are respectively provided in association with the memory elements, and the respective electro-optical elements are activated for display by total output of a plurality of the memory elements.

Still another example of a display device according to the present invention, in the display device in which a memory element captures data from a signal line via a first active element (active element A) in between during a selection period of the first active element selected by a selection line, and an electro-optical element performs display according to storage contents of the memory element, has an arrangement such that the number of the memory elements, which are provided in association with the respective electro-optical elements and with respect to each of the signal lines, is the same as the number of bits which are associated with at least a portion of desired gray-levels for display, the display device further including second active elements (active elements B) which are provided in association with the respective memory elements, and bit selection lines which are routed so as to be shared by control input terminals of the second active elements having the equivalent bit order to each other, either one of the bit selection lines being selected at a time for each bit order, the bit selection lines activating the second active elements to store the data in the associated memory element via the first active element during a selection period of the selection line, the respective electro-optical elements being activated for display by total output of a plurality of the memory elements.

Further, it is preferable that a display device according to the present invention, in either of the foregoing arrangements, has an arrangement in which each of the electro-optical elements is aligned in a matrix, and the bit selection line is shared by adjacent row intervals. With this arrangement, it is possible to downsize a wired area, thereby increasing the number of gray-levels.

Further, it is preferable that a display device according to the present invention, in either of the foregoing arrangements, has an arrangement in which the bit selection line is divided into two groups, and the divided bit selection lines are disposed at row intervals in a dispersed manner. With this arrangement, the number of wires is balanced, thereby improving uniformity of display.

Further, it is more preferable that a display device according to the present invention, in either of the foregoing arrangements, further includes decode means for decoding selection data of the bit selection line. With this arrangement, the proportion of a wired area can be made smaller.

It is particularly preferable that the present invention is adopted in the case where a RAM (Random Access Memory) is formed integrally with a display device outside of a display area, the RAM having memory elements respectively associated with electro-optical elements in a display area and receiving data of an image and/or letters to be displayed in a display device from an external device such as a CPU or the like.

With this arrangement, low power consumption is realized by reading data out of the RAM so as to be in parallel and displaying the read-out data in each electro-optical element. However, only the presence of a D/A converter between the RAM and the electro-optical element invalidates the effect of low power consumption realized by the parallel data.

Therefore, an arrangement of the present invention, in which instead of the D/A converter, a digital memory is provided between the RAM and the electro-optical element so as to perform multi-gray-level display, is preferable in that low power consumption that is aimed in the foregoing arrangement can be realized.

Note that, in the foregoing arrangement, an image memory provided outside the display area is represented as the RAM. This is because a DRAM configuration suffices for the image memory which is only required to temporarily store data. Thus, an SRAM configuration is not particularly necessary.

Further, it is preferable that a display device according to the present invention, in either of the foregoing arrangements, has an arrangement in which the memory element is made up of a ferroelectric thin-film capacitor.

With this arrangement, a circuit area required for the memory element can be made smaller than that of an SRAM circuit using a transistor such as a TFT.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A display device, comprising:

electro-optical elements, each of which is disposed in each area arranged in a matrix;

active elements (A), each of which is provided in said each area; and memory elements, each of which captures data from a signal line via said active element (A) in between, and activates each said electro-optical element for display by output, wherein:

two or more said memory elements associated with said each electro-optical element are provided with respect to each of said signal lines, and said each electro-optical element is activated for display by output, in part or in full, from said two or more memory elements which are provided in association with said electro-optical element.

2. The display device set forth in claim 1, wherein said memory element is made up of a ferroelectric thin-film capacitor.

3. A display device, comprising:

active elements (A) connected to selection lines and signal lines;

memory elements, each of which captures data from the signal line via said active element (A) in between;

electro-optical elements, each of which performs display in accordance with storage contents of said memory element; and active elements (B), each of which is provided in association with each of said memory elements, wherein the number of said memory elements, which are provided in association with the respective electro-optical elements and with respect to each of said signal lines, is the same as the number of bits which are associated with at least a portion of desired gray-levels and/or images for display, and the display device further comprising bit selection lines which are routed so as to be shared by control input terminals of said active elements (B) having the equivalent bit order to each other, either one of the bit selection lines being selected at a time for each bit order, the bit selection lines activating said active elements (B) to store the data in the associated memory element via said active element (A) during a selection period of the selection line, and to output the data stored in the associated memory element with respect to said electro-optical element during a non-selection period of the selection line.

4. The display device set forth in claim 3, wherein each of said electro-optical elements is aligned in a matrix, and said bit selection line is shared by adjacent row intervals.

5. The display device set forth in claim 4, wherein said bit selection line is divided into two groups, and the divided bit selection lines are disposed at row intervals in a dispersed manner.

6. The display device set forth in claim 3, further comprising decode means for decoding selection data of said bit selection line.

7. The display device set forth in claim 3, wherein said memory element is made up of a ferroelectric thin-film capacitor.

8. A display device, comprising:

active elements (A) connected to selection lines and signal lines;

memory elements, each of which captures data from the signal line via said active element (A) in between while said active element (A) is selected by the selection line;

electro-optical elements, each of which performs display in accordance with storage contents of said memory element; and active elements (C), each of which is provided in association with said each memory element between said memory element and said electro-optical element, wherein the number of said memory elements, which are provided in association with said respective electro-optical elements and with respect to each of said signal lines, is the same as the number of bits which are associated with at least a portion of desired gray-levels and/or images for display, and said memory elements are respectively provided in association with the different selection lines via the different active elements (A) in between, the display device further comprising bit selection lines which are routed so as to be shared by control input terminals of said active elements (C) having the equivalent bit order to each other, either one of the bit selection lines being selected at a time for each bit order, the bit selection lines activating said active elements (C) to output the data stored in the associated memory element with respect to said electro-optical element.

9. The display device set forth in claim 8, wherein each of said electro-optical elements is aligned in a matrix, and said bit selection line is shared by adjacent row intervals.

10. The display device set forth in claim 9, wherein said bit selection line is divided into two, and the divided bit selection lines are disposed at row intervals in a dispersed manner.

11. The display device set forth in claim 8, further comprising decode means for decoding selection data of said bit selection line.

12. The display device set forth in claim 8, wherein said memory element is made up of a ferroelectric thin-film capacitor.

13. A display device, comprising:

active elements (A) connected to selection lines and signal lines;

memory elements, each of which captures data from the signal line via said active element (A) in between while said active element (A) is selected by the selection line; and electro-optical elements, each of which performs display in accordance with storage contents of said memory element, wherein:

the number of said memory elements, which are provided in association with said respective electro-optical elements and with respect to each of said signal lines, is the same as the number of bits which are associated with at least a portion of desired gray-levels for display, and said memory elements are respectively provided in association with the different selection lines via the different active elements (A) in between, and said respective electro-optical elements are activated for display by total output of a plurality of said memory elements which are formed in association with said electro-optical elements.

14. The display device set forth in claim 13, wherein each of said electro-optical elements is aligned in a matrix, and said bit selection line is shared by adjacent row intervals.

15. The display device set forth in claim 14, wherein said bit selection line is divided into two, and the divided bit selection lines are disposed at row intervals in a dispersed manner.

16. The display device set forth in claim 13, further comprising decode means for decoding selection data of said bit selection line.

17. The display device set forth in claim 13, wherein said memory element is made up of a ferroelectric thin-film capacitor.

18. A display device, comprising:

active elements (A) connected to selection lines and signal lines;

memory elements, each of which captures data from the signal line via said active element (A) in between;

electro-optical elements, each of which performs display in accordance with storage contents of said memory element; and active elements (B), each of which is provided in association with said each memory element, wherein the number of said memory elements, which are provided in association with said respective electro-optical elements and with respect to each of said signal lines, is the same as the number of bits which are associated with at least a portion of desired gray-levels for display, the display device further comprising bit selection lines which are routed so as to be shared by control input terminals of said active elements (B) having the equivalent bit order to each other, either one of the bit selection lines being selected at a time for each bit order, the bit selection lines activating said active elements (B) to store the data in the associated memory element via said active element (A) during a selection period of the selection line, said respective electro-optical elements being activated for display by total output of a plurality of said memory elements which are formed in association with said electro-optical elements.

19. The display device set forth in claim 18, wherein each of said electro-optical elements is aligned in a matrix, and said bit selection line is shared by adjacent row intervals.

20. The display device set forth in claim 19, wherein said bit selection line is divided into two, and the divided bit selection lines are disposed at row intervals in a dispersed manner.

21. The display device set forth in claim 18, further comprising decode means for decoding selection data of said bit selection line.

22. The display device set forth in claim 18, wherein said memory element is made up of a ferroelectric thin-film capacitor.

* * * * *